US008397445B2

(12) United States Patent
Ohnishi et al.

(10) Patent No.: US 8,397,445 B2
(45) Date of Patent: Mar. 19, 2013

(54) JOINT CONNECTION IN WHICH A BEAM END OR COLUMN BASE OF A STRUCTURE, OR A PERIPHERAL MEMBERS RIGIDLY JOINED TO THE BEAM END OR COLUMN BASE, ARE JOINED TO ANOTHER STRUCTURE VIA SUPPORTING MEANS

(71) Applicants: Katsunori Ohnishi, Tokyo (JP); Chika Iri, Tokyo (JP)

(72) Inventors: Katsunori Ohnishi, Tokyo (JP); Chika Iri, Tokyo (JP)

(73) Assignee: Sekisui Chemical Co., Ltd., Osaka (JP)

( * ) Notice: Subject to any disclaimer, the term of this patent is extended or adjusted under 35 U.S.C. 154(b) by 0 days.

(21) Appl. No.: 13/624,305

(22) Filed: Sep. 21, 2012

(65) Prior Publication Data

US 2013/0019557 A1 Jan. 24, 2013

Related U.S. Application Data

(62) Division of application No. 11/995,219, filed as application No. PCT/JP2006/314104 on Jul. 14, 2006.

(30) Foreign Application Priority Data

| | | |
|---|---|---|
| Jul. 15, 2005 | (JP) | 2005-207831 |
| Sep. 1, 2005 | (JP) | 2005-254142 |
| Jun. 12, 2006 | (JP) | 2006-162545 |
| Jun. 12, 2006 | (JP) | 2006-162548 |

(51) Int. Cl.
*E04B 1/98* (2006.01)

(52) U.S. Cl. ..... 52/167.4; 52/167.1; 52/169.9; 52/263; 52/296

(58) Field of Classification Search ..... 52/296, 52/263, 167.3, 167.4, 169.9, 167.1, 169.13, 52/295; 248/615, 618, 678, 679
See application file for complete search history.

(56) References Cited

U.S. PATENT DOCUMENTS

| | | | | |
|---|---|---|---|---|
| 965,185 | A * | 7/1910 | Hickman | 52/296 |
| 1,341,335 | A * | 5/1920 | MacIlwaine | 52/292 |
| 2,053,226 | A * | 9/1936 | Ruge | 52/113 |
| 2,602,616 | A * | 7/1952 | Helmond | 248/615 |
| 3,431,691 | A * | 3/1969 | Werner et al. | 266/193 |
| 3,538,659 | A * | 11/1970 | McDermott | 52/236.3 |
| 3,630,474 | A * | 12/1971 | Minor | 52/98 |
| 3,789,174 | A * | 1/1974 | Barkan et al. | 200/294 |

(Continued)

FOREIGN PATENT DOCUMENTS

| | | |
|---|---|---|
| JP | 10131289 | 5/1998 |
| JP | 2000154507 | 6/2000 |

(Continued)

OTHER PUBLICATIONS

Column. (n. d.). Dictionary.com Unabridged. Retrieved Apr. 8, 2011, from Dictionary.com website: http://dictionary.reference.com/browse/column.

*Primary Examiner* — Brian Glessner
*Assistant Examiner* — Joshua Ihezie
(74) *Attorney, Agent, or Firm* — Sughrue Mion, PLLC

(57) ABSTRACT

A joint connection (20) in which a beam end and a column base of a structure (10), or a peripheral member rigidly joined thereto, are joined to another structure (13) capable of receiving a bending moment through supporting means 22. A deformation due to a very small geometric movement within a resilient range is generated in the supporting means (22) by a reaction force generated at a joint portion with the other structure 13 due to an external force exerted on a beam or a column. This structure is capable of generating a bending moment Mr in a reverse direction to a bending moment Mc generated in the column base or the beam end.

6 Claims, 29 Drawing Sheets

U.S. PATENT DOCUMENTS

| | | | | | |
|---|---|---|---|---|---|
| 3,794,277 | A | * | 2/1974 | Smedley et al. | 248/548 |
| 3,869,836 | A | * | 3/1975 | Allen | 52/23 |
| 3,906,689 | A | * | 9/1975 | Nakayama | 52/167.6 |
| 3,921,039 | A | * | 11/1975 | Robinson et al. | 361/830 |
| 4,064,668 | A | * | 12/1977 | Carter | 52/295 |
| 4,269,400 | A | * | 5/1981 | Jensen | 267/153 |
| 4,301,989 | A | * | 11/1981 | Kallenbach | 248/548 |
| 4,417,426 | A | * | 11/1983 | Meng | 52/126.7 |
| 4,469,956 | A | * | 9/1984 | D'Amato | 290/55 |
| 4,520,649 | A | * | 6/1985 | Barton, Sr. | 72/457 |
| 4,546,581 | A | * | 10/1985 | Gustafson | 52/169.9 |
| 4,606,142 | A | * | 8/1986 | Reneau | 43/1 |
| 4,976,077 | A | * | 12/1990 | Tucker | 52/126.6 |
| 5,063,719 | A | * | 11/1991 | Matsuo et al. | 52/296 |
| 5,199,690 | A | * | 4/1993 | Marshall | 267/64.25 |
| 5,205,528 | A | * | 4/1993 | Cunningham | 248/602 |
| 5,359,821 | A | * | 11/1994 | Merriman | 52/169.9 |
| 5,775,038 | A | * | 7/1998 | Sauvageot | 52/167.8 |
| 5,782,043 | A | * | 7/1998 | Duncan et al. | 52/167.1 |
| 5,946,865 | A | * | 9/1999 | Raychman | 52/167.1 |
| 6,115,972 | A | * | 9/2000 | Tamez | 52/167.4 |
| 6,141,928 | A | | 11/2000 | Platt | |
| 6,243,996 | B1 | * | 6/2001 | Oliver et al. | 52/126.1 |
| 6,381,907 | B1 | * | 5/2002 | MacKarvich | 52/126.6 |
| 6,530,182 | B2 | * | 3/2003 | Fanucci et al. | 52/167.3 |
| 6,665,990 | B1 | * | 12/2003 | Cody et al. | 52/295 |
| 6,701,680 | B2 | * | 3/2004 | Fanucci et al. | 52/167.3 |
| 6,718,710 | B2 | * | 4/2004 | Platt | 52/296 |
| 6,820,389 | B1 | | 11/2004 | Macchietto | |
| 7,065,927 | B2 | * | 6/2006 | Powell et al. | 52/167.3 |
| 7,076,926 | B2 | * | 7/2006 | Kasai et al. | 52/167.8 |
| 7,228,661 | B2 | * | 6/2007 | Rizzotto | 52/170 |
| 7,533,506 | B2 | | 5/2009 | Platt | |
| 7,637,071 | B2 | * | 12/2009 | Pryor | 52/698 |
| 2003/0066251 | A1 | * | 4/2003 | Cusimano | 52/169.9 |
| 2003/0221385 | A1 | | 12/2003 | Platt | |
| 2004/0074161 | A1 | * | 4/2004 | Kasai et al. | 52/167.1 |

FOREIGN PATENT DOCUMENTS

| | | |
|---|---|---|
| JP | 2002121747 | 4/2002 |
| JP | 200444285 | 2/2004 |

* cited by examiner

JOINT CONNECTION IN WHICH A BEAM END OR COLUMN BASE OF A STRUCTURE, OR A PERIPHERAL MEMBERS RIGIDLY JOINED TO THE BEAM END OR COLUMN BASE, ARE JOINED TO ANOTHER STRUCTURE VIA SUPPORTING MEANS

TECHNICAL FIELD

This application is a Divisional of U.S. application Ser. No. 11/995,219, filed Jan. 10, 2008; which is a 371 of PCT/JP2006/314104, filed Jul. 14, 2006; the disclosures of each of which are incorporated herein by reference.

BACKGROUND ART

As a column base joint connection for a building, there is one which rigidly joints column bases of columns that the building has to a foundation, as described in Japanese Patent Application Laid-Open (JP-A) No. 2005-2777. That is, the column base of the column is rigidly joined to the foundation; displacement of an intersecting angle between the column and the foundation is made smaller than that in the case of a pin joint; and consequently, deformation of the entire building can be reduced.

In addition, when a simple beam is hung over a large span, a beam having a large cross section is required in order to reduce bending deformation of the beam. In this case, the beam has a large size and a large weight.

Consequently, in the prior art, there have been methods adopted in which a beam is of a trussed structure or a lattice structure and the beam is reduced in weight by converting a bending force exerted on the beam to an axial force, the beam is reduced in cross-section by applying prestress on the beam, or the beam is reduced in cross-section by forming the beam to be a suspension structure.

DISCLOSURE OF THE INVENTION

Problems to be Solved by the Invention

An object of the present invention is to minimize deformation of the entire building in a joint connection of a column base.

Another object of the present invention is to be capable of keeping up with a large span by a small cross section in a joint connection of a beam end.

Means for Solving Problem

According to a first aspect of the present invention, there is provided a joint connection in which a beam end and a column base of a structure, or a peripheral member rigidly joined thereto, are joined to other structure capable of receiving a bending moment via supporting means, wherein deformation due to a very small geometric movement within a resilient range is generated in the supporting means by a reaction force generated at a joint portion with the other structure due to an external force exerting on a beam or a column, thereby being capable of generating a bending moment Mr in a reverse direction to a bending moment Mc generated in the column base or the beam end.

According to a second aspect, the supporting means is a combination of at least two rods, each rod having one end joined to the beam end or the peripheral member and having the other end joined to a lateral structure; and the one end and the other end of each of the rods being separated respectively, and an interval between the one end of each of the rods is narrower than an interval between the other end of each of the rods.

According to a third aspect, the supporting means is a combination of at least two rods, each rod having one end coupled by a coupling member, the coupling member being joined to the beam end or the peripheral member, and the other end of each of the rods being joined to a lateral structure; and the one end and the other end of each of the rods being separated respectively, and an interval between the one end of each of the rods is narrower than an interval between the other end of each of the rods.

According to a fourth aspect, the supporting means is a combination of at least two rods, the rods having lower ends joined to a lower structure and having upper ends joined to the column base or the peripheral member; wherein the upper ends and the lower ends of the rods are separated respectively, and an upper end interval is narrower than a lower end interval.

According to a fifth aspect, the supporting means is of a combination of at least two rods, the rods having lower ends joined to a lower structure, upper ends of the rods being coupled by a coupling member, and the coupling member being joined to the column base or the peripheral member; and the upper ends and the lower ends of the rods are separated respectively, and an upper end interval is narrower than a lower end interval.

According to a sixth aspect, the building structure is placed on a coupling portion of the coupling member and the rods.

According to a seventh aspect, one of joint portions of the coupling member and the rods is a rigid joint.

According to an eighth aspect, the joint of the column base or the peripheral member and the coupling member is of a tensile joint where introduction tensile force is exerted therebetween.

According to a ninth aspect, the tensile joint is provided with a resilient bridging member at the bottom of the coupling member, the resilient bridging member having both ends which are supported to the coupling member or the rods, the resilient bridging member having an intermediate portion which is separated from the coupling member to be a rational cross section with small deformation, and the intermediate portion of the resilient bridging member and the coupling member being passed through by a bolt which is joined to the column base or the peripheral member.

According to a tenth aspect, the moments are Mr=Mc.

According to an eleventh aspect, further, the moments are Mr>Mc.

According to a twelfth aspect, the lower structure is a foundation.

According to a thirteenth aspect, the lower structure is a lower story building structure.

According to a fourteenth aspect, there is provided a building including a frame structure which includes a plurality of columns, at least one of the columns being joined to a lower structure by the joint connection of the column base as set forth in any one of aspects 1 or 4 to 13.

According to a fifteenth aspect, there is provided a building including beams, at least one of the beams being joined to a lateral structure by the joint connection of the beam end as set forth in any one of aspects 1 to 3, 10, or 11.

According to a sixteenth aspect, there is provided a bridge including beams, at least one of the beams being joined to a lateral structure by the joint connection of the beam end as set forth in any one of aspects 1 to 3, 10, or 11.

In the building structure according to the present invention, each column base of a plurality of mutually parallel arranged columns is joined to a lower structure. However, for example, a column base for one of the columns may be the joint connection characteristic of the present invention, and a column base for the other column may be a joint connection not characteristic of the present invention, a simple pin joint connection may be applied.

In the column base joint connection according to the present invention, a pair of rods provided between the lower structure and the column base is not limited to those composed of two rods. For example, those composed of four rods may be used, wherein two rods are provided on the gable side, and the other two rods are provided on the girder side in the column base of one column.

In the joint connection according to the present invention, joints of the upper ends or the lower ends of two rods and the column base or the lower structure may be pin-jointed or rigidly jointed.

In the present invention, "rod" is not limited to a rod-like shape, but, a steel-like shape and a plate-like shape are included.

Effect of the Invention (a) In a joint connection in which a beam end and a column base of a structure, or a peripheral member rigidly joined thereto are joined to other structure via supporting means, a bending moment Mr in a reverse direction to a bending moment Mc generated in the column base or the beam end due to a force orthogonally exerting on the axis of the beam or the column can be generated by deformation of the supporting means (deformation due to a very small geometric movement within a resilient range of the supporting means), whereby deformation of the beam end or the column base (displacement of an intersecting angle between the beam or the column and other structure) is reduced and deformation of the entire structure is minimized.

(b) A pair of rods combined of two rods is provided between a lateral structure and ends of a beam, each of the two rods have one end joined to the lateral structure and have their other end joined to the ends of the beam, an interval on one end sides of the two rods is made narrower than an interval on the other end sides; whereby axial forces of the two rods exert a bending moment on the ends of the beam, and the bending moment reduces deformation of the beam (displacement of an intersecting angle between the beam and the lateral structure) and operates so as to minimize deformation of the entire beam.

(c) When a shear force exerts on the beam and the axial forces are generated in the two rods, a bending moment Mr generated at the ends of the beam due to the axial forces of the two rods is in a reverse direction to a bending moment Mc generated at the ends of the beam due to the shear force exerting on the beam. Therefore, deformation of the beam due to the bending moment Mc and deformation of the beam due to the bending moment Mr are balanced out with each other, deformation of the beam is reduced, and deformation of the entire beam is minimized.

(d) As described above in (b) and (c), the deformation of the beam can be reduced by the bending moments Mr and Mc exerting on the ends of the beam; therefore, the other ends of the two rods are not rigidly joined to the lateral structure, but, deformation of the beam is reduced even in the case of easily pin-jointing, and deformation of the entire beam can be minimized.

(e) A coupling member is joined to the beam end, a pair of rods combined of two rods is provided between a lateral structure and a coupling member, the two rods have their other ends joined to the lateral structure and have their one end joined to the coupling member, and one end interval between the two rods is made narrower than the other end interval therebetween; accordingly, axial forces of the two rods exert a bending moment on the coupling member, and the bending moment reduces deformation of the beam and operates so as to minimize deformation of the entire structure.

(f) The coupling member is made of different composition material from a structural member joined to the beam end; and therefore, the coupling member can be high stiffness as compared with a horizontal member as a structural member in which the coupling member is joined to the beam end. Therefore, the above described (e) bending moment Mr in which the axial forces of the two rods exert on the coupling member is stably transferred to the beam end; and consequently, this can be balanced out with the bending moment Mc generated in the beam end. With this configuration, deformation of the entire building can be stably minimized.

(g) The length of the coupling member can be prolonged irrespective of a position of the joint point of the coupling member fixed to the beam end. This means that a flange length f from the above described joint point of the coupling member and the beam end to a joint point of the coupling member and the rod can be prolonged; therefore, the previously described (e) bending moment Mr in which the axial forces of the two rods exert on the coupling member can be increased. With this configuration, deformation of the entire building can be minimized.

(h) A pair of rods combined of two rods is provided between a column base and a lower structure, the two rods have their lower ends joined to the lower structure and also have their upper ends joined to the column base, an upper interval between the two rods is made narrower than a lower interval therebetween; accordingly, axial forces of the two rods exert a bending moment on the column base, and the bending moment reduces deformation of the column (displacement of the intersecting angle between a column and a foundation) and operates so as to minimize deformation of the entire building.

(i) When shear force exerts on the column of the building structure and the axial forces are generated in the two rods, a bending moment Mr generated in the column base due to the axial forces of the two rods is in a reverse direction to a bending moment Mc generated in the column base due to the shear force exerting on the column. Therefore, deformation of the column due to the bending moment Mc and deformation of the column due to the bending moment Mr are balanced out with each other, deformation of the column is reduced, and deformation of the entire building is minimized.

(j) As described above in (h) and (i), the deformation of the column can be reduced by the bending moments Mr and Mc exerting on the base member; therefore, the lower end of the two rods are not rigidly joined to the lower structure, but, deformation of the column is reduced even in the case of easily pin-jointing, and deformation of the entire building can be minimized.

(k) A coupling member is joined to a column base, a pair of rods combined of two rods is provided between a lower structure and the coupling member, the two rods have their lower ends joined to the lower structure and have their upper ends joined to the coupling member, an upper interval between the two rods is made narrower than a lower interval therebetween; accordingly, axial forces of the two rods exert a bending moment on the coupling member, and the bending moment reduces deformation of the column (displacement of an intersecting angle between a column and a foundation) and operates so as to minimize deformation of the entire building.

(l) The coupling member is made of a different material composition from the structural member joined to the column base; therefore, the coupling member can have a high stiffness as compared with a horizontal member as a structural member in which the coupling member is joined to the column base. Therefore, the above described (k) bending moment Mr in which the axial forces of the two rods exert on the coupling member is stably transferred to the column base; consequently, this can be balanced out with the bending moment Mc generated in the column base. With this configuration, deformation of the entire building can be stably minimized.

(m) The length of the coupling member made up of a cross member can be prolonged irrespective of a position of a rigid joint point of the coupling member fixed to the column base (including a floor beam joint piece welded to the column base). This means that a flange length f from the above described rigid joint point of the coupling member and the column base to a joint point of the coupling member and the rod can be prolonged; therefore, the previously described (a) bending moment Mr in which the axial forces of the two rods exert on the coupling member can be increased. With this configuration, deformation of the entire building can be minimized.

(n) When a building structure is placed on rigid joint portions of the above described (n) coupling member (cross member) and the rods (diagonal member and/or vertical member), a degree of fixation of a horizontal member (beam, girder, girth, ground sill, and the like) as a structural member joined to a column base of the building structure can be strengthened. When the previously described (k) bending moment Mr, which the axial forces of two rods exert on the coupling member, is transferred to the column base (floor beam) of the building structure, a distance between the column of the building structure and a bearing supporting point (placing point) to the coupling member of the building structure becomes large, and the supporting point reaction force is reduced (in this regard, however, when the bending moment Mr is not bearing the weight of the building structure, but a pull-out force is exerted on the supporting point, there is no effect of the reduction in the supporting point reaction force, and consequently, the reaction force is exerted on other beam fixing bolt).

(o) Joint portions of the above described (k) coupling member and the rods can be of a rigid joint.

(p) Variation in shear force Q2 exerting on the coupling member can be avoided by rigidly jointing the coupling member (cross member) and the upper ends of the rods (diagonal member and/or vertical member). A joint point r1 of the lower end of one rod and a lower structure, a joint point r2 of the upper end of the one rod and the coupling member (cross member), a joint point s1 of the lower end of the other one rod (diagonal member) and the lower structure, and a joint point s2 of the upper end of the other rod and the coupling member (cross member) will be considered. At this time, if all the r1, r2, s1, and s2 are pin joints, the previously described (a) bending moment Mr in which axial forces of the two rods exert on the coupling member becomes large; however, the strength of a building structure is largely dependent on a ratio between the shear force Q1 exerting on a column and the above described Q2, and therefore, the strength of the building structure cannot be preliminarily specified. On the other hand, if the coupling member (cross member) and the upper ends (r2 and/or s2) of the rods (diagonal member and/or vertical member) are rigidly joined, the bending moment Mr does not become large to such an extent as mentioned above; however, the difference in the strength of the building structure due to the ratio between Q1 and Q2 is almost eliminated, and therefore, the strength of the building structure can be preliminarily specified without depending on plans.

(q) A coupling member is tensionally joined to a column base, a pair of rods combined of two rods is provided between a lower structure and the coupling member, the two rods have their lower ends joined to the lower structure and also have their upper ends joined to the coupling member, an upper interval between the two rods is made narrower than a lower interval therebetween; accordingly, the axial forces of the two rods exert a bending moment on the coupling member, and the bending moment reduces deformation of a column (displacement of an intersecting angle between the column and a foundation) and operates so as to minimize deformation of the entire building.

(r) Tensile force tensionally jointing the coupling member to the column base is introduced between the column base and the coupling member. As a result, the introduction tensile force becomes a resistance force (tear-off resistance force) against a tear-off force that tears off the column base from the coupling member; rotation of a building structure with respect to the coupling member (rotation of the column with respect to a vertical line, and rotation of a floor beam with respect to a horizontal line) is reduced; and therefore, deformation of the entire building can be stably minimized.

(s) The length of the coupling member made up of a cross member can be prolonged irrespective of a position of a tensile joint point of the coupling member fixed to the column base (including a floor beam joint piece welded to the column base). This means that a flange length f from the above described tensile joint point of the coupling member and the column base to a joint point of the coupling member and the rod can be prolonged; therefore, the previously described (a) bending moment Mr, which the axial forces of the two rods exert on the coupling member, can be increased. With this configuration, deformation of the entire building can be surely minimized.

(t) Variation in shear force Q2 exerting on the coupling member can be avoided by rigidly jointing the coupling member (cross member) and the upper ends of the rods (diagonal member and/or vertical member). A joint point r1 of the lower end of one rod and a lower structure, a joint point r2 of the upper end of the one rod and the coupling member (cross member), a joint point s1 of the lower end of the other one rod (diagonal member) and the lower structure, and a joint point s2 of the upper end of the other rod and the coupling member (cross member) will be considered. At this time, if all the r1, r2, s1, and s2 are pin joints, the previously described (q) bending moment Mr, which axial forces of the two rods exert on the coupling member, becomes large; however, the strength of a building structure is largely dependent on a ratio between shear force Q1 exerting on a column and the above described Q2, and therefore, the strength of the building structure cannot be preliminarily specified. On the other hand, if the coupling member (cross member) and the upper ends (r2 and/or s2) of the rods (diagonal member and/or vertical member) are rigidly joined, the bending moment Mr does not become large to such an extent as mentioned above; however, the difference in the strength of the building structure due to the ratio between Q1 and Q2 is almost eliminated, and the strength of the building structure can be preliminarily specified without depending on plans.

(u) Both ends of a resilient bridging member are supported to a coupling member or rods, an intermediate portion of the resilient bridging member is made apart from the coupling member, and a bolt passing through the intermediate portion of the resilient bridging member and the coupling member is tensionally joined to a column base of a column; accordingly, the coupling member can be tensionally joined to the column base by a simple structure.

(v-1) A bending moment Mr and a bending moment Mc are set to Mr=Mc, and accordingly, a column base is in a rigid joint state with respect to a lower structure (the column base does not rotate, and an intersecting angle between a column and a foundation is not displaced); consequently, deformation of the column can be reduced. The column base does not move.

(v-2) The bending moment Mr and the bending moment Mc are set to Mr=Mc, and accordingly, the end of a beam is in a rigid joint state with respect to a rigid body (the end of the beam does not rotate, and an intersecting angle between the beam and the rigid body is not displaced); consequently, deformation of the beam can be reduced. The end of the beam does not move.

(w-1) A bending moment Mr and a bending moment Mc are set to Mr>Mc, and accordingly, a column base has deformation due to Mc, which is moved back in a reverse direction by Mr, and becomes in a super rigid joint state, so that deformation of the column can be reduced as compared with the above mention (v-1). A base member moves in a shear direction.

(w-2) The bending moment Mr and the bending moment Mc are set to Mr>Mc, and accordingly, the end of a beam has deformation due to Mc, which is moved back in a reverse direction by Mr, and becomes in a super rigid joint state, so that deformation of the beam can be reduced as compared with the above mention (v-2). The end of the beam moves in a shear direction.

(x) In a joint connection in which a lower structure is a foundation and a column of a building structure is joined to the foundation, the above mentioned (h) to (w) can be realized.

(y) In a joint connection in which a lower structure is a lower story building structure and a column of an upper story building structure is joined to a capital or a beam of the lower story building structure, the above mentioned (h) to (w) can be realized, and high stiffness can be obtained in the beam-priority work method.

(z-1) In a building, the above mentioned (a), and (h) to (y) can be realized.

(z-2) In a building, the above mentioned (a) to (g), (v), and (w) can be realized.

(z-3) In a bridge, the above mentioned (a) to (g), (v), and (w) can be realized.

BRIEF DESCRIPTION OF THE DRAWINGS

FIG. 16(A) is a perspective view seen from outside, and FIG. 16(B) is a perspective view seen form inside;

DESCRIPTION OF REFERENCE NUMERALS

Figure 1:
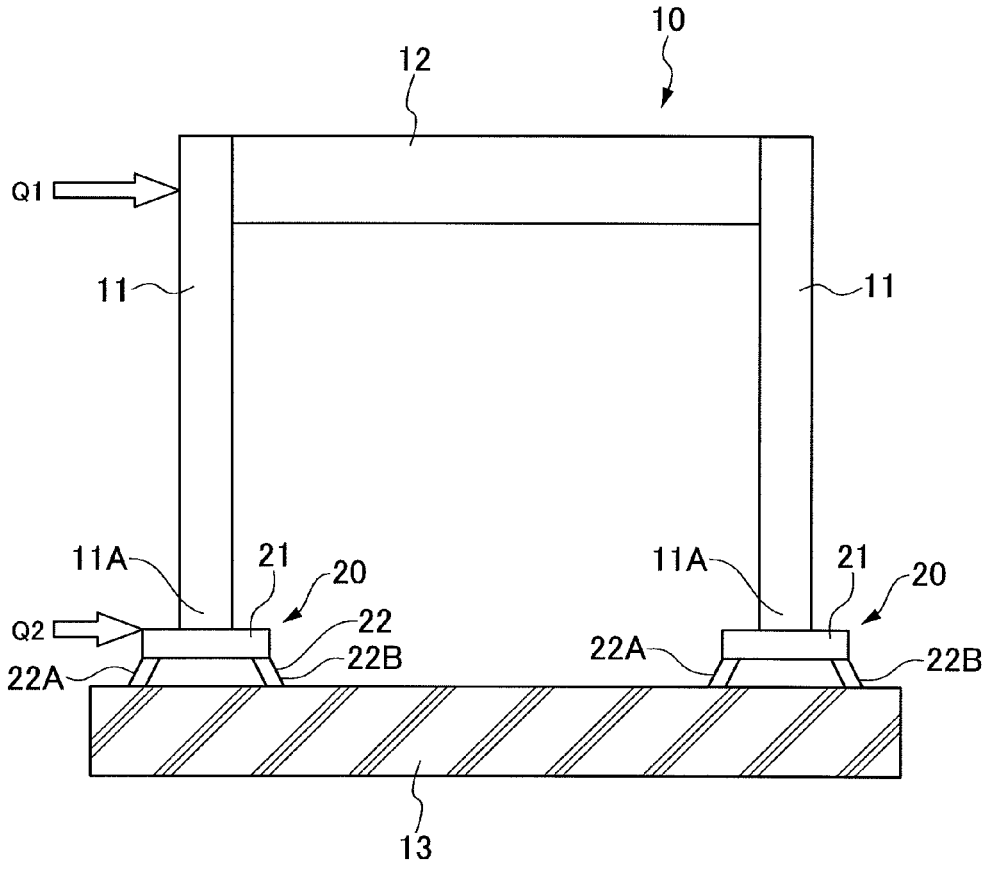
FIG. 1 is a schematic view showing a gate frame structure of an embodiment 1.

10, 30, and 50 Building structure
11, 31, and 51 Column
11A, 31A, and 51A Column base
13 and 34 Foundation (Lower structure)
20, 40, and 60 Column base joint connection
21, 41, and 61 Base member
22, 42, and 62 Pair of rods
22A, 22B, 42A, 42B, 62A, and 62B Rod
70 Lower story building structure
72 Beam (Lower structure)
Q1 and Q2 Shear force
Ta and Tb Axial force
Mc and Mr Bending moment
110 and 160 Building structure
111 Column
111A Column base
113 and 163 Floor beam (Horizontal member)
114 Foundation (Lower structure)
120 Column base joint connection
121 Base member
122 Pair of rods
122A and 122B Rod
150 Resilient bridging member
151 Bolt
170 Lower story building structure (Lower structure)
210 Beam structure

211 Beam
211A Beam end
212 Rigid body
220 Beam joint connection
222 Pair of rods
222A and 222B Rod

BEST MODE FOR CARRYING OUT THE INVENTION

Embodiments according to the present invention will be described below based on the drawings.

EMBODIMENTS

Embodiment 1

FIGS. 1 to 4

Figure 2:
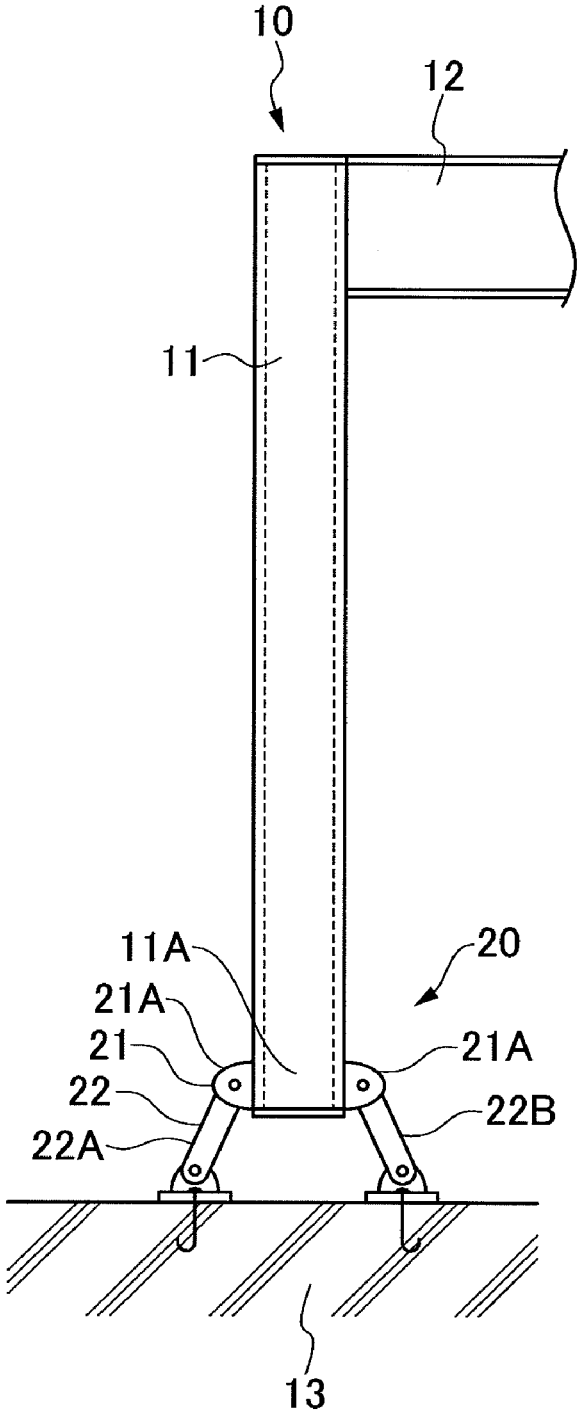
FIG. 2 is a front view showing the gate frame structure.

As shown in FIGS. 1 and 2, a building structure 10 is of a gate frame structure in which mutually parallel arranged columns 11 and 11 are coupled by a beam 12 that is rigidly joined to the upper ends of the columns. The building structure 10 has respective column bases 11A of the columns 11 and 11, each of column bases 11A being joined to a foundation 13 (lower structure) by a column base joint connection 20. Composition of the column base joint connection 20 will be described below.

The column base joint connection 20 rigidly joints mounting members 21A to the column base 11A, and the mounting members 21A serve as a base member 21 or as a peripheral member rigidly joined to the column base 11A.

The column base joint connection 20 is provided with a pair of rods 22 combined of two rods 22A and 22B as supporting means between the foundation 13 and the base member 21. The two rods 22A and 22B each have their lower end pin-jointed (applicable even in a rigid joint) to the foundation 13, and their upper end pin-jointed (applicable even in the rigid joint) to the base member 21. An upper interval between the two rods 22A and 22B is made narrower than a lower interval therebetween (the rods 22A and 22B are formed in a truncated chevron shape with each other, and the upper interval on the column 11 side is made narrower than the lower interval on the foundation 13 side). In the present embodiment, the rod 22A on the shear forward side, along a direction of horizontal shear force Q1 exerted on the column 11, is tilted backward, and the rod 22B on the shear backward side is tilted forward.

Figure 3:
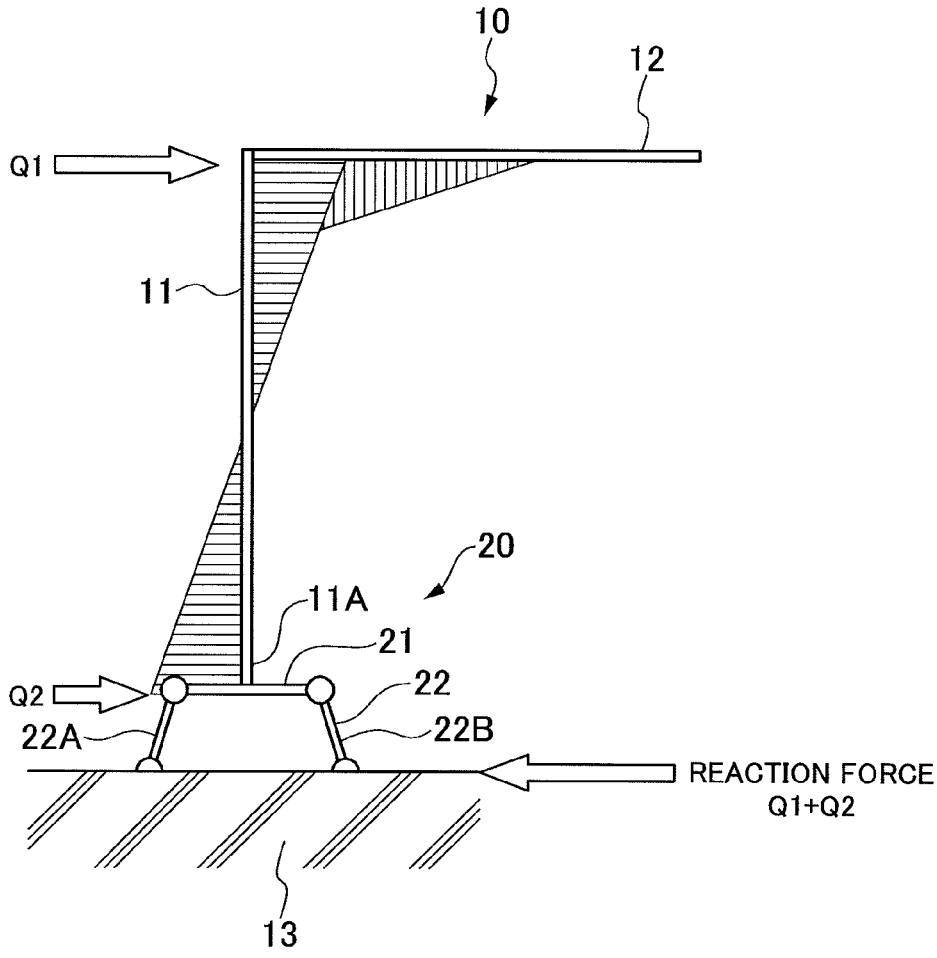
FIG. 3 is a schematic view showing horizontal force exerting on a column base joint connection.
Figure 4:
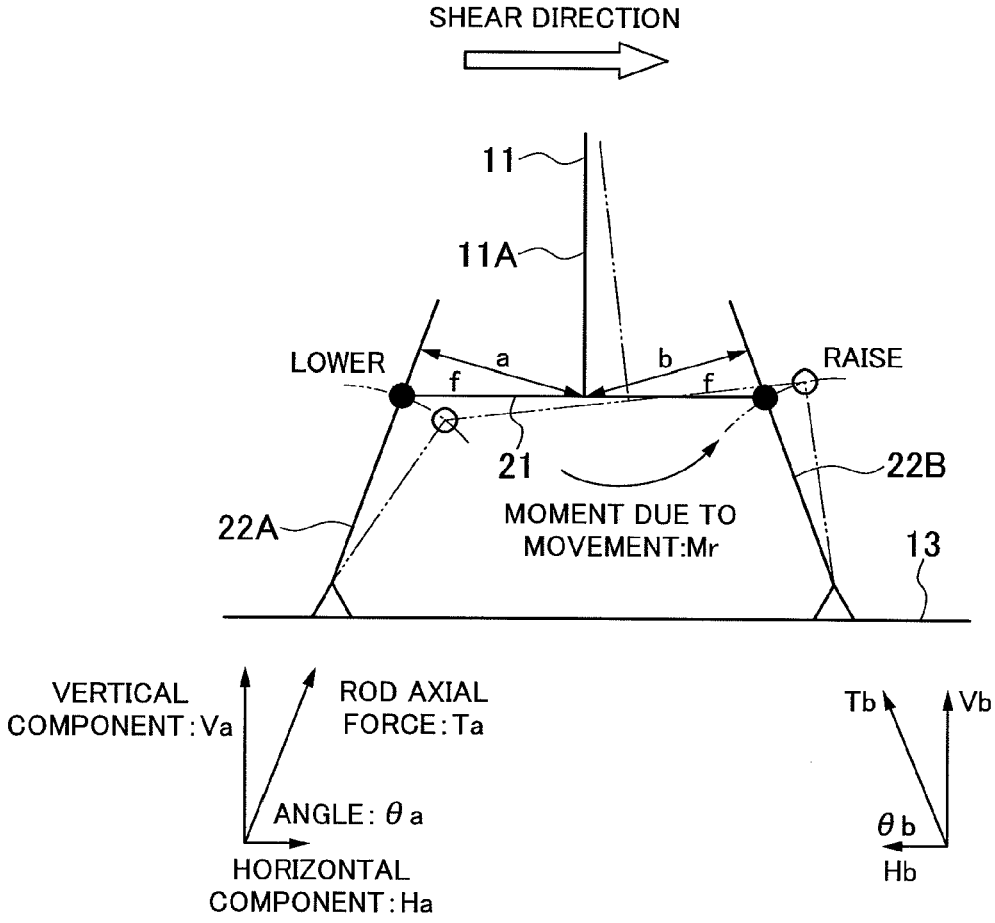
FIG. 4 is a schematic view showing a bending moment exerting on the column base joint connection.

A supporting mechanism by the column base joint connection 20 of the building structure 10 will be described below (FIGS. 3 and 4).

(1) The horizontal shear force Q1 is exerted on the column 11. Further, in the present embodiment, horizontal shear force Q2 (wall load, wind pressure, and the like corresponding to lower half of the column 11) in the same direction as that of the shear force Q1 exerted on the column 11, is exerted on the base member 21. In addition, the shear forces Q1 and Q2 are shear forces virtually exerted on one column.

At this time, supporting point reaction force Q=Q1+Q2 is exerted on joint portions of the two rods 22A and 22B to the foundation 13.

(2) A bending moment Mc due to the shear force Q1 exerted on the column 11 is generated in the column base 11A (a rigid joint point with the base member 21).

(3) Axial forces Ta and Tb are generated in the respective rods 22A and 22B by the supporting point reaction force Q(Q1+Q2) exerted on the two rods 22A and 22B. In addition, the axial forces Ta and Tb are generated when the base member 21 moves towards the same shear direction by the shear forces Q1 and Q2 exerted on the column 11.

Then, a bending moment Mr, due to the axial forces Ta and Tb of the two rods 22A and 22B, is generated at the column base 11A (the rigid joint point with the base member 21). The bending moment Mr is in a reverse direction to the direction of the bending moment Mc. The bending moment Mr lowers the upper end of the rod 22A on the shear forward side, and raises the upper end of the rod 22B on the shear backward side, so that the base member 21 is slightly rotated.

The following equations (1) to (5) are formed when horizontal components of the axial forces Ta and Tb are Ha and Hb, vertical components thereof are Va and Vb, arm lengths of the moments with respect to the column base 11A (the rigid joint point with the base member 21) of the axial forces Ta and Tb are a and b, a flange length from a joint point with the column base 11A to a joint point with the rod 22A in the base member 21 is f and a flange length therefrom to a joint point with the rod 22B is f, an intersecting angle made by the rod 22A with respect to the foundation 13 is θa (FIG. 4), and an intersecting angle made by the rod 22B with respect to the foundation 13 is θb (FIG. 4). In addition, an axial force of the column 11 is disregarded.

$$Q1+Q2=Ha+Hb \tag{1}$$

$$Va+Vb=0 \tag{2}$$

$$Mr=Ta\times a+Tb\times b \tag{3}$$

$$Mr=(Ha/\cos\theta a)\times a+(Hb/\cos\theta b)\times b \tag{4}$$

$$a=f\cdot\sin\theta a,\ b=f\cdot\sin\theta b \tag{5}$$

Therefore, in order to increase the bending moment Mr, there is required an increase in angles θa and θb of the rods 22A and 22B, an increase in the flange length f of the base member 21, or an increase in the shear force Q2 exerted on the base member 21.

The increase in the shear force Q2 exerted on the base member 21 can be realized by receiving floor load and wind pressure by beam members and furring strips and transferring the same to the base member 21.

Furthermore, in the case where the joint of the rod 22A (22B) and the base member 21 or the foundation 13 is pin-jointed, a resistance against movement of the base member 21 is small; therefore, the base member 21 is largely moved, and Mr can also be increased. In the case of a rigid joint, since the resistance against movement of the base member 21 is large, Mr is small as compared with the pin joint; however, deformation of the rod 22A (22B) is very small, and therefore, generation of microvibration can be suppressed.

(4) In the case of Mr=Mc, the column base 11A is in a rigid joint state (the column base 11A does not rotate, and a relative angle between the column 11 and the foundation 13 is invariance).

(5) In the case of Mr>Mc, the column base 11A is moved back in a reverse direction to a deformation direction due to Mc. This is referred to as a super rigid joint state. The base member 21 moves to the shear direction (direction of Q1).

(6) In the case of Mr<Mc, the column base 11A is in a semi rigid joint state (weaker than the rigid joint). The base member 21 moves in a reverse direction to the shear direction.

According to the present embodiment, the following operation effects are achieved.

(a) The base member 21 is rigidly joined to the column base 11A, a pair of rods 22 combined of two rods 22A and 22B is provided between the foundation 13 and the base member 21, the two rods 22A and 22B each have their lower end joined to the foundation 13 and also have their upper end joined to the base member 21, the upper interval between the two rods 22A and 22B is narrower than the lower interval therebetween; accordingly, the axial forces Ta and Tb of the two rods 22A and 22B exert a bending moment Mr on the base member 21, and the bending moment Mr reduces the deformation of the column 11 (displacement of the intersecting angle between the column 11 and the foundation) and operates so as to minimize deformation of the entire building.

(b) When the shear force Q1 is exerted on the column 11 of the building structure 10 and the axial forces Ta and Tb are generated in the two rods 22A and 22B, the bending moment Mr, generated in the column base 11A due to the axial forces Ta and Tb of the two rods 22A and 22B, is in a reverse direction to the bending moment Mc, generated in the column base 11A due to the shear force Q1 exerted on the column 11. Therefore, the deformation of the column 11 due to the bending moment Mc and deformation of the column 11 due to the bending moment Mr are balanced out with each other, deformation of the column 11 is reduced, and deformation of the entire building is minimized.

(c) As described above in (a) and (b), the deformation of the column 11 can be reduced by the bending moments Mr and Mc exerted on the base member 21; therefore, the lower end of the two rods 22A and 22B are not rigidly joined to the foundation 13, but, deformation of the column 11 is reduced even in the case of pin-jointing, and the deformation of the entire building can be minimized.

(d) When the bending moment Mr and the bending moment Mc are set to Mr=Mc, and accordingly, the column base 11A is in a rigid joint state with respect to the foundation 13 (the column base 11A does not rotate, and the intersecting angle between the column 11 and the foundation 13 is not displaced), and deformation of the column 11 can be reduced.

(e) When the bending moment Mr and the bending moment Mc are set to Mr>Mc; and accordingly, the column base 11A has deformation due to Mc, which is moved back in a reverse direction by Mr, and becomes in a super rigid joint state, so that deformation of the column 11 can be reduced as compared with the above mention (d). The base member 21 moves in the shear direction.

(f) When the shear force Q2 having the same direction as the shear force Q1 exerting on the column 11 is exerted on the base member 21; and accordingly, supporting point reaction force Q=Q1+Q2 in which the foundation 13 exerts on the two rods 22A and 22B is increased; therefore, the axial forces Ta and Tb of the two rods 22A and 22B are increased, the bending moment Mr is increased, and effect due to providing the two rods 22A and 22B can be further improved.

(g) The above mentioned (a) to (f) can be realized in the joint connection 20 in which the lower structure is the foundation 13 and the column 11 of the building structure 10 is joined to the foundation 13.

Embodiment 2

Figure 5:
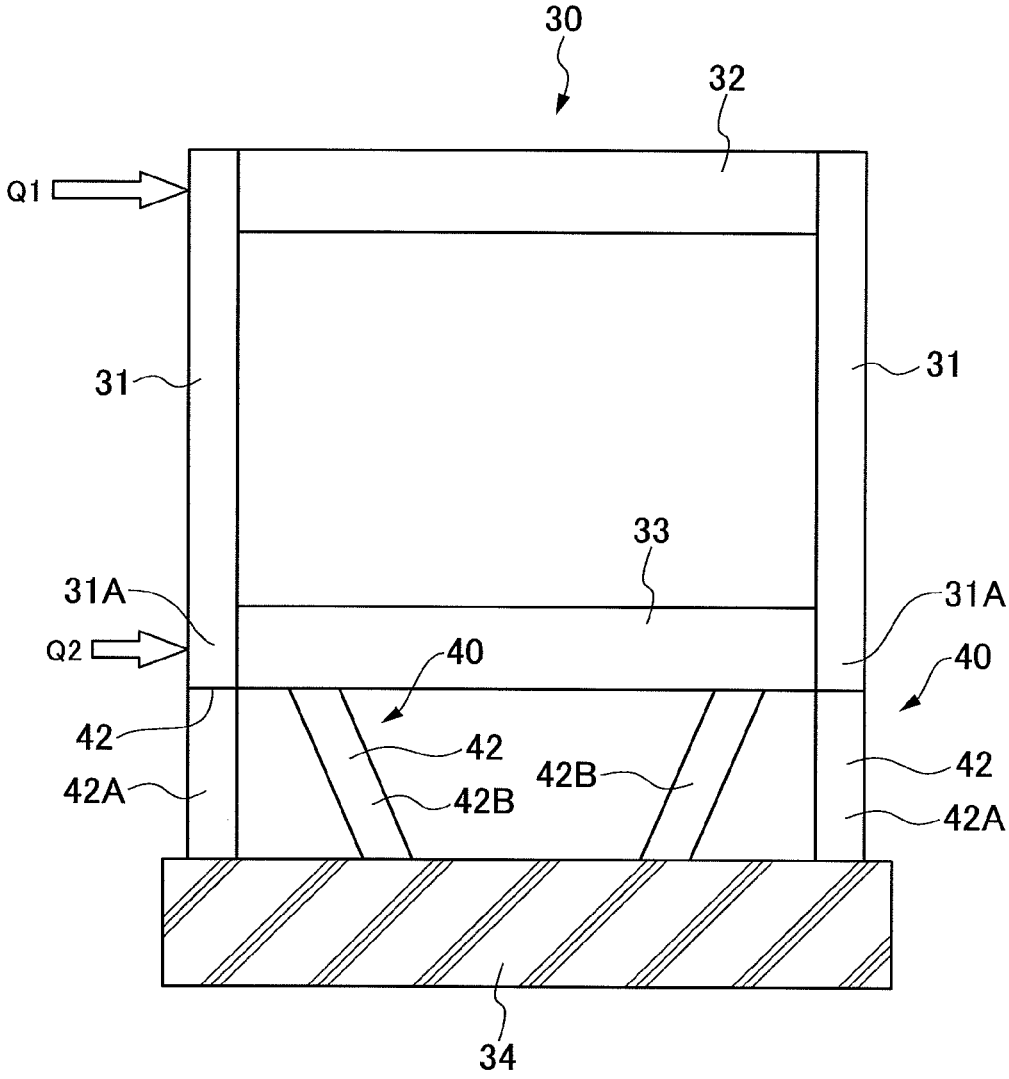
FIG. 5 is a schematic view showing a frame unit structure of an embodiment 2.
Figure 6:
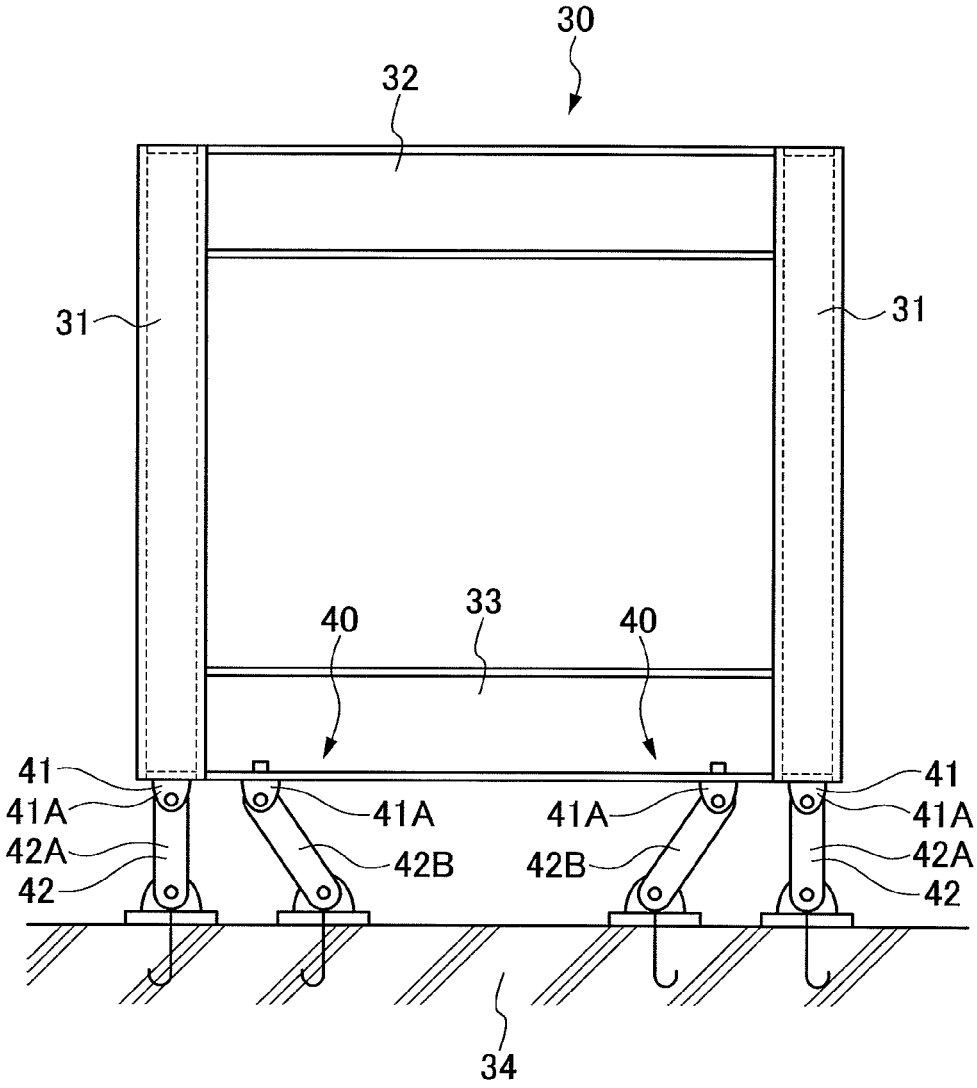
FIG. 6 is a front view showing the frame unit structure.

FIGS. 5 and 6

As shown in FIGS. 5 and 6, a building structure 30 is of a frame unit structure in which mutually parallel arranged columns 31 and 31 are coupled by a ceiling beam 32 that is rigidly joined to the upper ends of the columns, and are coupled by a floor beam 33 that is rigidly joined to the lower ends of the columns. The building structure 30 has respective column bases 31A of the columns 31 and 31, each of the column bases 31A being joined to a foundation 34 (lower structure) by a column base joint connection 40. The composition of the column base joint connection 40 will be described below.

The column base joint connection 40 rigidly joints the floor beam 33 (flange 41A) to the column bases 31A, and the floor beam 33 serves as a base member 41 as a peripheral member rigidly joined to the column base 31A.

The column base joint connection 40 is provided with a pair of rods 42 combined of two rods 42A and 42B between the foundation 34 and the base member 41. The two rods 42A and 42B each have their lower end pin-jointed (applicable even in a rigid joint) to the foundation 34 and their upper end pin-jointed (applicable even in the rigid joint) to the base member 41. An upper interval between the two rods 42A and 42B is narrower than a lower interval therebetween (the rods 42A and 42B are formed in a truncated chevron shape with each other, and the upper interval on the column 31 side is made narrower than the lower interval on the foundation 34 side). In the present embodiment, the rod 42A on the shear forward side, along a direction of horizontal shear force Q1 exerted on the column 31, is vertically arranged, and the rod 42B on the shear backward side is tilted forward.

A supporting mechanism according to the column base joint connection 40 of the building structure 30 is substantially the same as the supporting mechanism according to the column base joint connection 20 of the building structure 10. Therefore, when the shear force Q1 is exerted on the column 31 of the building structure 30 and the axial forces Ta and Tb are generated in the two rods 42A and 42B, and as a result, the base member 41 is moved in the same shear direction by the shear force Q1, a bending moment Mr generated in the column base 31A (a rigid joint point with the base member 41) due to the axial forces Ta and Tb of the two rods 42A and 42B is in a reverse direction to a bending moment Mc generated in the column base 31A (the rigid joint point with the base member 41) due to the shear force Q1 exerting on the column 31. In addition, a shear force Q2 (wall load, wind pressure, and the like corresponding to lower half of the column 31), in the same direction as that of the shear force Q1 exerted on the column 31 is exerted on the base member 41.

According to the present embodiment, the following operation effects are achieved.

(a) The base member 41 is rigidly joined to the column base 31A, a pair of rods 42 combined of two rods 42A and 42B is provided between the foundation 34 and the base member 41, the two rods 42A and 42B each have their lower end joined to the foundation 34 and their upper end joined to the base member 41, the upper interval between the two rods 42A and 42B is narrower than the lower interval therebetween; accordingly, the axial forces Ta and Tb of the two rods 42A and 42B exert the bending moment Mr on the base member 41, and the bending moment Mr reduces the deformation of the column 31 (displacement of an intersecting angle between the column 31 and the foundation 34) and operates so as to minimize deformation of the entire building.

b) When the shear force Q1 is exerted on the column 31 of the building structure 30 and the axial forces Ta and Tb are generated in the two rods 42A and 42B, the bending moment Mr, generated in the column base 31A due to the axial forces Ta and Tb of the two rods 42A and 42B, is in a reverse direction to the bending moment Mc generated in the column base 31A due to the shear force Q1 exerted on the column 31. Therefore, the deformation of the column 31 due to the bending moment Mc and deformation of the column 31 due to the bending moment Mr are balanced out with each other, the deformation of the column 31 is reduced, and the deformation of the entire building is minimized.

(c) As described above in (a) and (b), the deformation of the column 31 can be reduced by the bending moments Mr and Mc exerted on the base member 41; therefore, the lower end of the two rods 42A and 42B are not rigidly joined to the foundation 34, but, deformation of the column 31 is reduced even in the case of pin-jointing, and deformation of the entire building can be minimized.

(d) When the bending moment Mr and the bending moment Mc are set to Mr=Mc, the column base 31A is in a rigid joint state with respect to the foundation 34 (the column base 31A does not rotate, and the intersecting angle between the column 31 and the foundation 34 is not displaced), and deformation of the column 31 can be reduced.

(e) When the bending moment Mr and the bending moment Mc are set to Mr>Mc, the column base 31A has a deformation due to Mc, which is moved back in a reverse direction by Mr, and becomes in a super rigid joint state, so that the deformation of the column 31 can be reduced as compared with the above mentioned (d). The base member 41 moves in the shear direction.

(f) When the shear force Q2 having the same direction as the shear force Q1 exerted on the column 31 is exerted on the base member 41, supporting point reaction force Q=Q1+Q2 which the foundation 34 exerts on the two rods 42A and 42B is increased; therefore, the axial forces Ta and Tb of the two rods 42A and 42B are increased, the bending moment Mr is increased, and the effect due to providing the two rods 42A and 42B can be further improved.

(g) The above mentioned (a) to (f) can be realized in the joint connection 40 in which the lower structure is the foundation 34 and the column 31 of the building structure 30 is joined to the foundation 34.

Embodiment 3

FIG. 7

Figure 7:
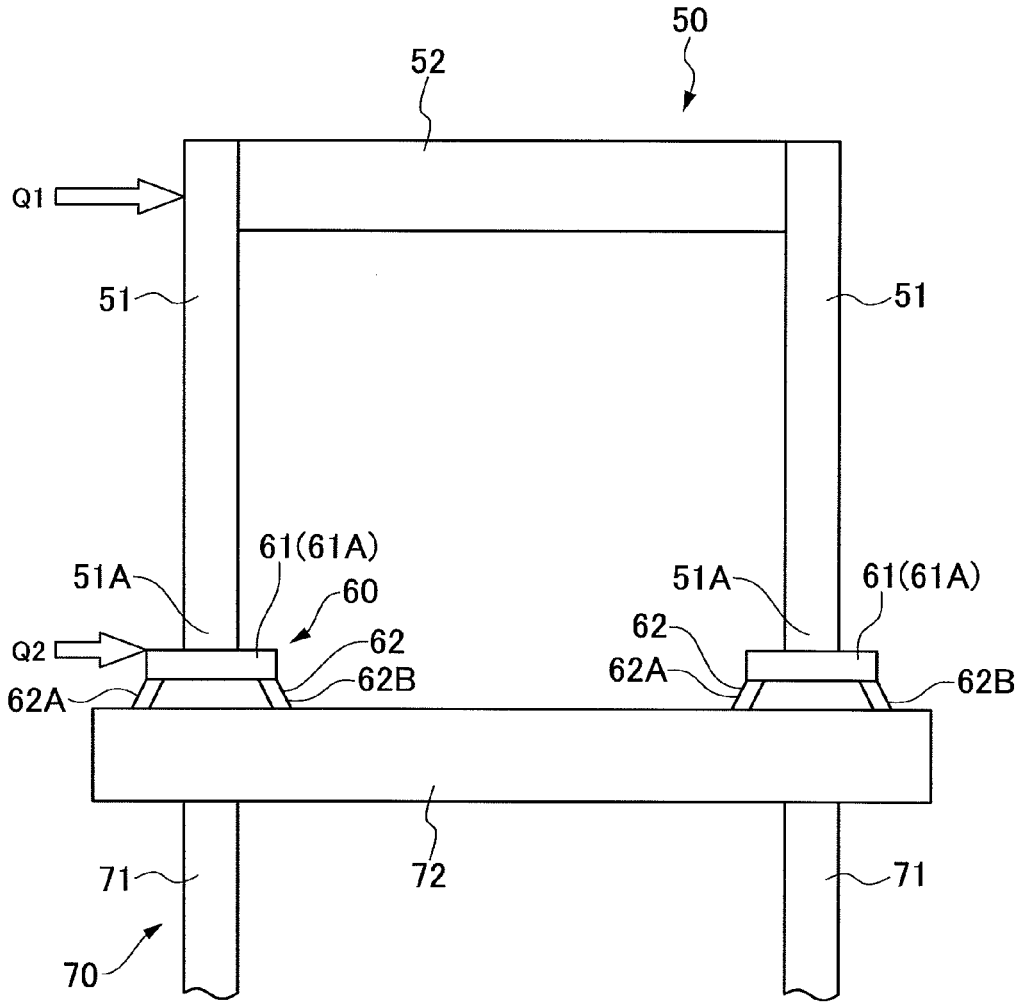
FIG. 7 is a schematic view showing a gate frame structure of an embodiment 3.

As shown in FIG. 7, a building structure 50 is of a gate frame structure in which mutually parallel arranged columns 51 and 51 are coupled by a beam 52 that is rigidly joined to the upper ends of the columns. The building structure 50 has respective column bases 51A of the columns 51 and 51, each of the column bases 51A being joined to a lower story building structure 70 by a column base joint connection 60. The lower story building structure 70 is of a frame structure in which columns 71 and a beam 72 are rigidly joined, and the column base 51A of the column 51 of its upper story building structure 50 is joined to the beam 72 by the column base joint connection 60. The composition of the column base joint connection 60 will be described below.

The column base joint connection 60 rigidly joints a flange 61A to the column base 51A, and the flange 61A serves as a base member 61 as a peripheral member rigidly joined to the column base 51A.

The column base joint connection 60 is provided with a pair of rods 62 combined of two rods 62A and 62B between the beam 72 and the base member 61. The two rods 62A and 62B each have their lower end pin-jointed (applicable even in a rigid joint) to the beam 72, and their upper end pin-jointed (applicable even in the rigid joint) to the base member 61. An upper interval between the two rods 62A and 62B is narrower than a lower interval therebetween (the rods 62A and 62B are formed in a truncated chevron shape with each other, and the upper interval on the column 51 side is made narrower than the lower interval on the beam 72 side). In the present embodiment, the rod 62A on the shear forward side along a direction of horizontal shear force Q1 exerted on the column 51 is vertically arranged, and the rod 62B on the shear backward side is tilted forward.

A supporting mechanism according to the column base joint connection 60 of the building structure 50 is substantially the same as the supporting mechanism according to the column base joint connection 20 of the building structure 10. Therefore, when the shear force Q1 is exerted on the column 51 of the building structure 50 and the axial forces Ta and Tb are generated in the two rods 62A and 62B, and as a result, the base member 61 is moved in the same shear direction by the shear force Q1, a bending moment Mr generated in the column base 51A (a rigid joint point with the base member 61) due to the axial forces Ta and Tb of the two rods 62A and 62B is in a reverse direction to a bending moment Mc generated in the column base 51A (the rigid joint point with the base member 61) due to the shear force Q1 exerting on the column 51. In addition, shear force Q2 (wall load, wind pressure, and the like corresponding to lower half of the column 51), in the same direction as that of the shear force Q1 exerted on the column 51, is exerted on the base member 61.

According to the present embodiment, the following operation effects are achieved.

(a) The base member 61 is rigidly joined to the column base 51A, a pair of rods 62 combined of two rods 62A and 62B is provided between the beam 72 and the base member 61, the two rods 62A and 62B each have their lower end joined to the beam 72 and their upper end joined to the base member 61, the upper interval between the two rods 62A and 62B is made narrower than the lower interval therebetween; accordingly, the axial forces Ta and Tb of the two rods 62A and 62B exert the bending moment Mr on the base member 61, and the bending moment Mr reduces deformation of the column 51 (displacement of an intersecting angle between the column 51 and the beam 72) and operates so as to minimize deformation of the entire building.

(b) When the shear force Q1 is exerted on the column 51 of the building structure 50 and the axial forces Ta and Tb are generated in the two rods 62A and 62B, the bending moment Mr, generated in the column base 51A due to the axial forces Ta and Tb of the two rods 62A and 62B, is in a reverse direction to the bending moment Mc generated in the column base 51A due to the shear force Q1 exerted on the column 51. Therefore, the deformation of the column 51 due to the bending moment Mc and the deformation of the column 51 due to the bending moment Mr are balanced out with each other, the deformation of the column 51 is reduced, and the deformation of the entire building is minimized.

(c) As described above in (a) and (b), the deformation of the column 51 can be reduced by the bending moments Mr and Mc exerted on the base member 61; therefore, the lower end of the two rods 62A and 62B are not rigidly joined to the beam 72, but, deformation of the column 51 is reduced even in the case of pin-jointing, and deformation of the entire building can be minimized.

(d) When the bending moment Mr and the bending moment Mc are set to Mr=Mc, the column base 51A is in a rigid joint state with respect to the beam 72 (the column base 51A does not rotate, and the intersecting angle between the column 51 and the beam 72 is not displaced), and deformation of the column 51 can be reduced.

(e) When the bending moment Mr and the bending moment Mc are set to Mr>Mc, the column base 51A has deformation due to Mc, which is moved back in a reverse direction by Mr, and becomes in a super rigid joint state, so that deformation of the column 51 can be reduced as compared with the above mention (d). The base member 61 moves in the shear direction.

(f) When the shear force Q2 having the same direction as the shear force Q1 exerted on the column 51 is exerted on the base member 61, supporting point reaction force Q=Q1+Q2 which the beam 72 exerts on the two rods 62A and 62B is increased; and therefore, the axial forces Ta and Tb of the two rods 62A and 62B are increased, the bending moment Mr is increased, and the effect due to providing the two rods 62A and 62B can be further improved.

(g) The above mentioned (a) to (f) can be realized in the joint connection 60 in which a lower structure is the beam 72 of the lower story building structure 70 and the column 51 of the upper story building structure 50 is joined to the beam 72.

Embodiment 4

FIG. 8

Figure 8:
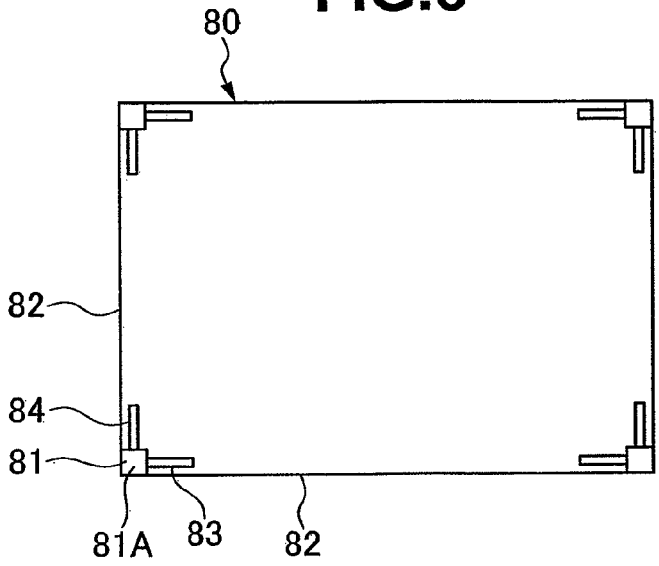
FIG. 8 is a schematic plan view showing a building structure of an embodiment 4.

As shown in FIG. 8, a building structure 80 is of a gate frame structure in which four mutually parallel arranged columns 81 are coupled by beams 82 (ceiling beam) that are rigidly joined to the upper ends of the columns. In addition, the building structure 80 may have four mutually parallel arranged columns 81 coupled along with beams (floor beam) that are rigidly joined to the lower ends of the columns. In each of the long-side sides and the short-side sides, which are intersected at the column 81 shown in FIG. 8 seen from the top, the building structure 80 has a column base 81A which is joined to a foundation or a lower story structure by column base joint connections 83 and 84. The column base joint connections 83 and 84 can be made of the same composition as the previously described column base joint connections 20, 40, and 60 or a column base joint connection 120 to be described later.

Embodiment 5

FIG. 9

Figure 9A:
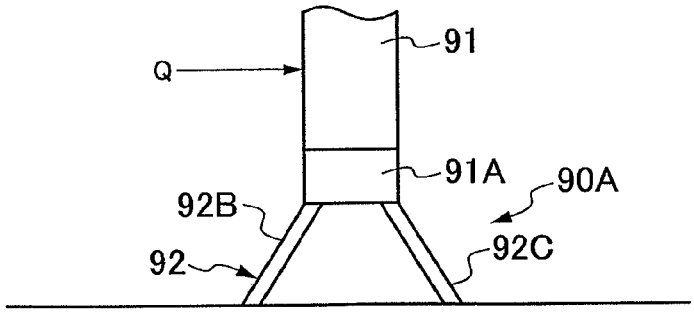
FIGS. 9(A)-9(B) are schematic views showing a column base joint connection of an embodiment 5.
Figure 9B:
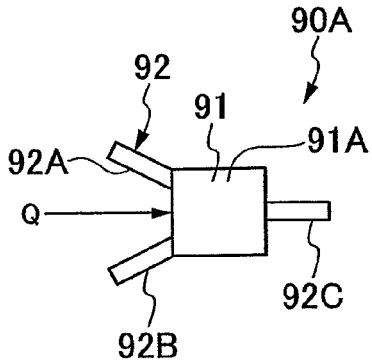

A column base joint connection 90A shown in FIG. 9 is provided with a pair of rods 90 combined of three rods 92A, 92B, and 92C between a lower structure and a column base (base member) 91A of a column 91. The three rods 92A to 92C each have their lower end pin-jointed (applicable even in a rigid joint) to the lower structure and their upper end pin-jointed (applicable even in the rigid joint) to the column base 91A. With regard to a direction along the horizontal shear force 9 exerted on the column 91 seen from the top of the column base joint connection 90A, the two rods 92A and 92B and the one rod 92C are located on opposite sides with the column 91 being put therebetween; and the two rods 92A and 92B are located on the shear forward side along a direction of the horizontal shear force 9 and located on the opposite sides of a vertical surface including the shear force 9 with each other, and arranged to be tilted backward. The one rod 92C is located on the shear backward side along the direction of the horizontal shear force 9 and within the vertical surface including the shear force 9, and arranged to be tilted forward. An upper interval between the two rods 92A and 92C is narrower than a lower interval therebetween, and an upper interval between the two rods 92B and 92C is narrower than a lower interval therebetween.

A supporting mechanism according to the column base joint connection 90A is substantially the same as the supporting mechanisms of the previously described column base joint connections 20, 40, and 60.

Embodiment 6

FIG. 10

Figure 10A:
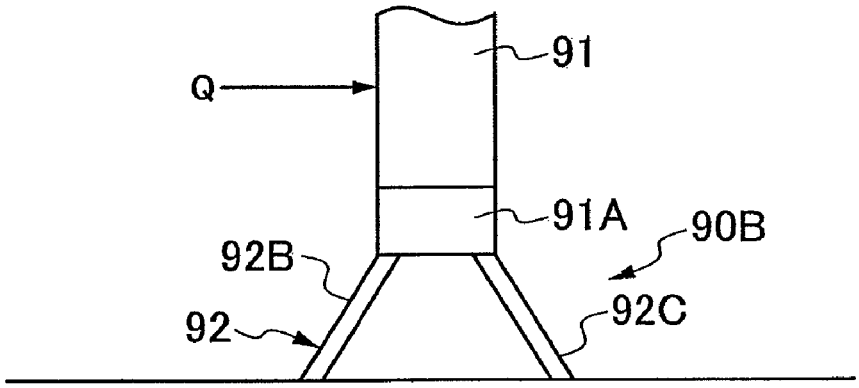
FIGS. 10(A)-10(B) are schematic views showing a column base joint connection of an embodiment 6.
Figure 10B:
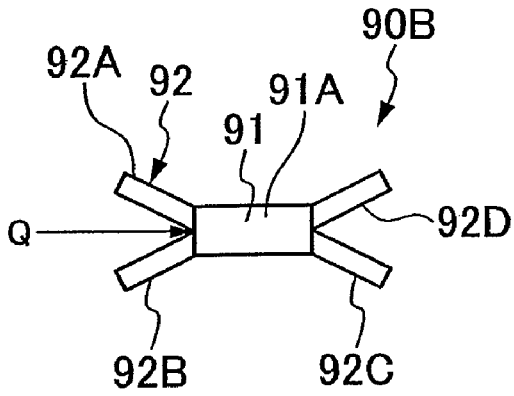

A column base joint connection 90B shown in FIG. 10 is provided with a pair of rods 92 combined of four rods 92A, 92B, 92C, and 92D between a lower structure and a column base (base member) 91A of a column 91. The four rods 92A to 92D each have their lower end pin-jointed (applicable even in a rigid joint) to the lower structure and their upper end pin-jointed (applicable even in the rigid joint) to the column base 91A. With regard to a direction along horizontal shear force Q exerted on the column 91 seen from the top of the column base joint connection 90B, the two rods 92A and 92B and the two rods 92C and 92D are located on opposite sides with the column 91 being put therebetween; and the two rods 92A and 92B are located on the shear forward side along a direction of the horizontal shear force Q and located on the opposite sides of a vertical surface including the shear force Q with each other, and are arranged to be tilted backward. The two rods 92C and 92D are located on the shear backward side along the direction of the horizontal shear force Q and located on the opposite sides of a vertical surface including the shear force Q with each other, and are arranged to be tilted forward.

An upper interval between the two rods 92A and 92C is narrower than a lower interval therebetween. An upper interval between the two rods 92B and 92D is narrower than a lower interval therebetween.

A supporting mechanism according to the column base joint connection 90B is substantially the same as the supporting mechanisms of the previously described column base joint connections 20, 40, and 60.

Embodiment 7

FIG. 11

Figure 11A:
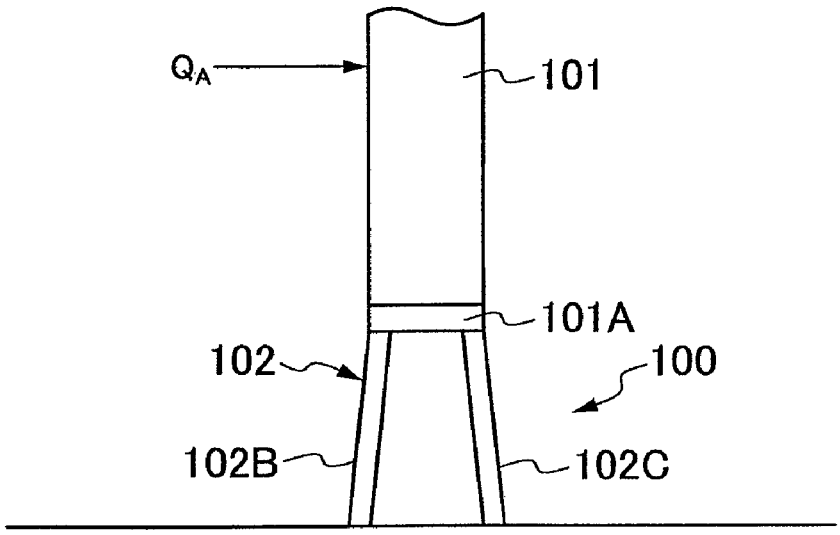
FIGS. 11(A)-11(B) are schematic views showing a column base joint connection of an embodiment 7.
Figure 11B:
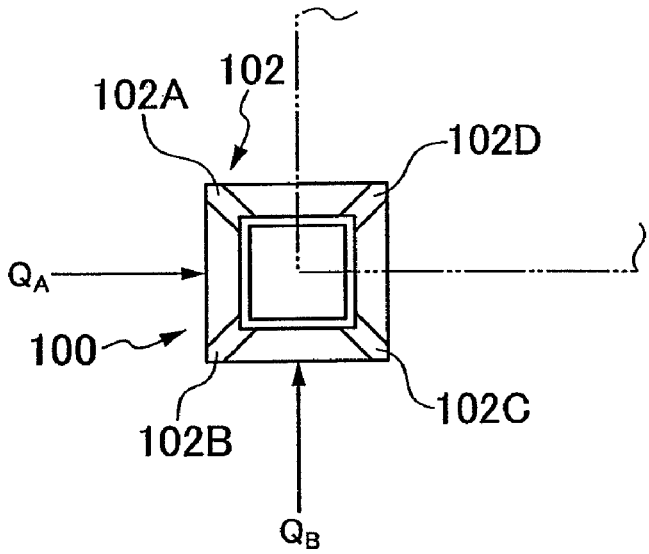
Figure 12:
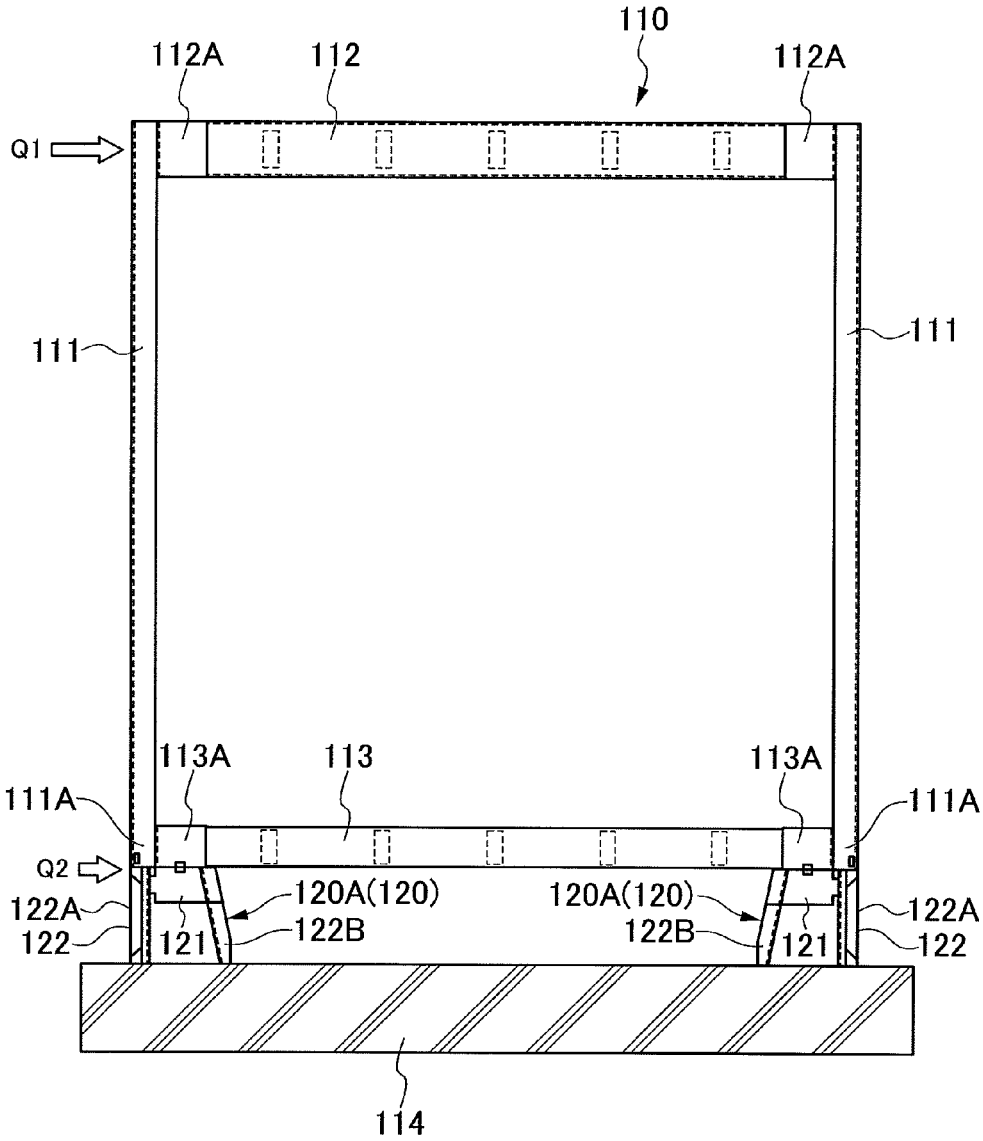
FIG. 12 is a schematic view showing a building structure of an embodiment 8.
Figure 13:
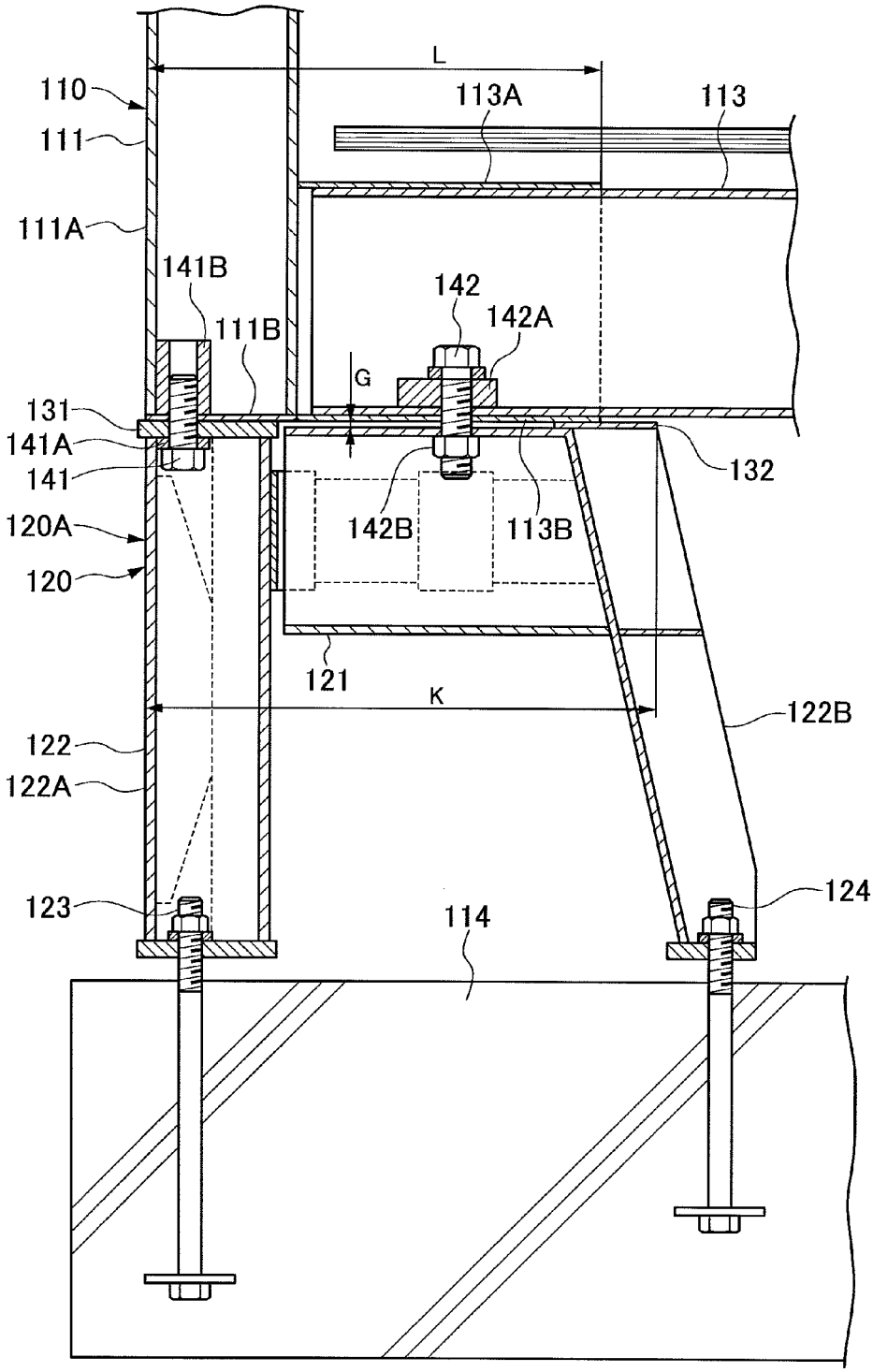
FIG. 13 is a relevant part enlarged view of FIG. 12.
Figure 14:
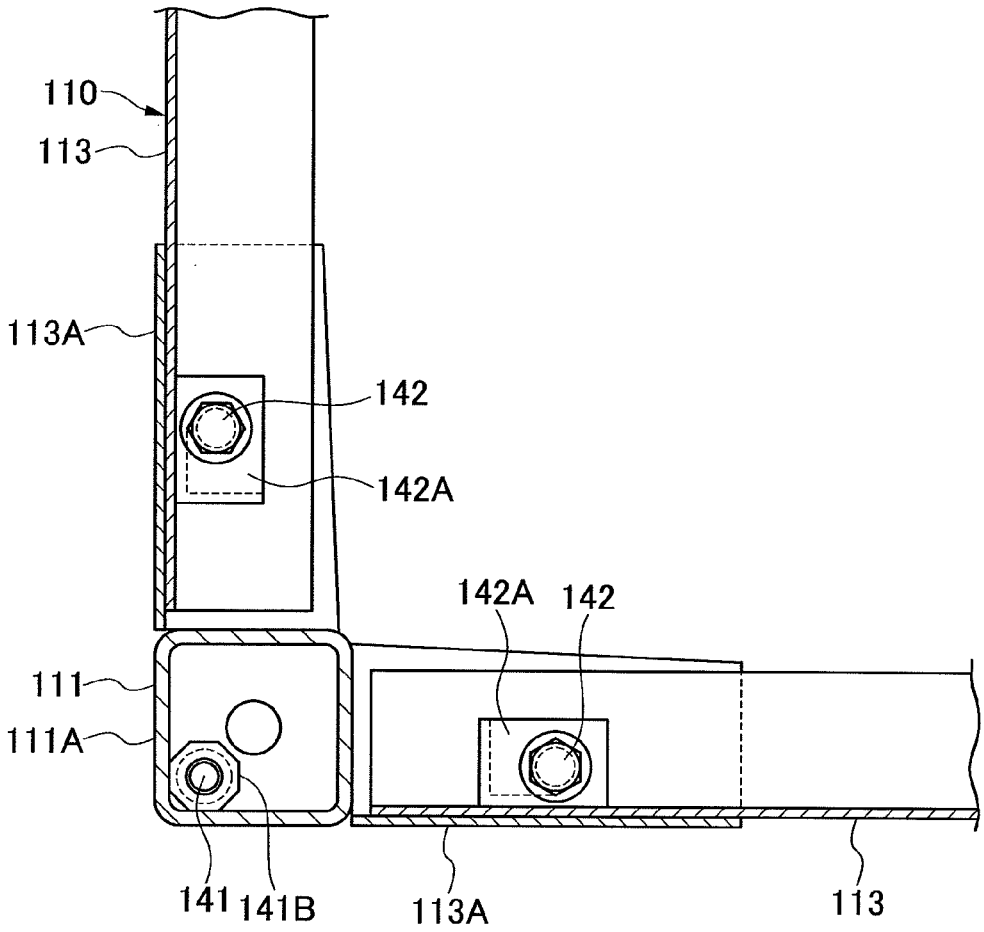
FIG. 14 is a plan view of FIG. 13.

A column base joint connection 100 shown in FIG. 11 is provided with a pair of rods 102 combined of four rods 102A to 102D between a lower structure and a column base (base member) 101A of a column 101 arranged in a standing condition at corners of a building structure 100A. The four rods 102A to 102D each have their lower end pin-jointed (applicable even in a rigid joint) to the lower structure and their upper end pin-jointed (applicable even in the rigid joint) to the column base 101A. The respective rods 102A to 102D are diagonally arranged in a radially downward direction disposed at an angle of 45 degrees with respect to the respective side surfaces of the column base 101A from the respective corners of the column base 101A having a square cross section.

With regard to a direction along the girder direction horizontal shear force QA exerted on the column 101 seen from the top of the column base joint connection 100, two rods 102A and 102B and two rods 102C and 102D are located on opposite sides with the column 101 therebetween. The two rods 102A and 102B are located on the shear forward side along the girder direction horizontal shear force QA and located on the opposite sides of a vertical surface including the shear force QA with each other, and are arranged to be tilted backward. The two rods 102C and 102D are located on the shear backward side along the direction of the girder direction horizontal shear force QA and located on the opposite sides of the vertical surface including the shear force QA with each other, and are arranged to be tilted forward. An upper interval between the two rods 102A and 102D is narrower than a lower interval therebetween. An upper interval between the two rods 102B and 102C is narrower than a lower interval therebetween.

With regard to a direction along the gable direction horizontal shear force QB exerted on the column 101 seen from the top of the column base joint connection 100, two rods 102B and 102C and two rods 102A and 102D are located on opposite sides with column 101 therebetween. The two rods 102B and 102C are located on the shear forward side along a direction of the gable direction horizontal shear force QB and located on the opposite sides of a vertical surface including the shear force QB with each other, and are arranged to be tilted backward. The two rods 102A and 102D are located on the shear backward side along the direction of the gable direction horizontal shear force QB and located on the opposite sides of the vertical surface including the shear force QB with each other, and are arranged to be tilted forward. An upper interval between the two rods 102A and 102B is narrower than a lower interval therebetween. An upper interval between the two rods 102C and 102D is narrower than a lower interval therebetween.

A supporting mechanism according to the column base joint connection 100 is substantially the same as the supporting mechanisms of the previously described column base joint connections 20, 40, and 60. The column base joint connection 100 includes, along with the functions of the previously described, column base joint connections 83 and 84, and can keep up with the girder direction horizontal shear force QA and the gable direction horizontal shear force QB.

Embodiment 8

FIGS. 12 to 21

As shown in FIGS. 12 to 15, a building structure (building unit) 110 is of a frame structure of a rectangular box frame structure. In each of the long-sides and short-sides that are mutually orthogonal as seen from the top, a ceiling beam 112 is rigidly joined to joint pieces 112A that are rigidly joined to the upper ends of mutually parallel arranged columns 111 and 111; accordingly, the upper ends of the columns 111 and 111 are coupled. At the same time, a floor beam 113 (horizontal member) is rigidly joined to joint pieces 113A that are rigidly joined to the lower ends (column base 111A) of the mutually parallel arranged columns 111 and 111; accordingly, the lower ends of the columns 111 and 111 are coupled.

In each of the long-sides and short-sides, the building structure 110 has respective column bases 111A of the columns 111 and 111, each of the column bases 111A being joined to a foundation 114 (lower structure) by a column base joint connection 120 of a column base joint trestle 120A.

The column base joint connection 120 of the column base joint trestle 120A will be described below.

As shown in FIGS. 16 to 19, the column base joint trestle 120A has one rod 122A arranged just beneath the column base 111A of the column 111 that is provided at a corner where the long-side and the short-side of the building structure 110 are intersected; each one rod 122B arranged just beneath each floor beam 113 of the long-side and the short-side; and each coupling member 121 couples 122A and 122B by being joined to the upper ends of both rods 122A and 122B in the long-side and the short-side. Two rods 122A and 122B constitute a pair of rods 122 in the long-side and the short-side respectively, and their upper intervals are made narrower than their lower intervals.

Figure 20:
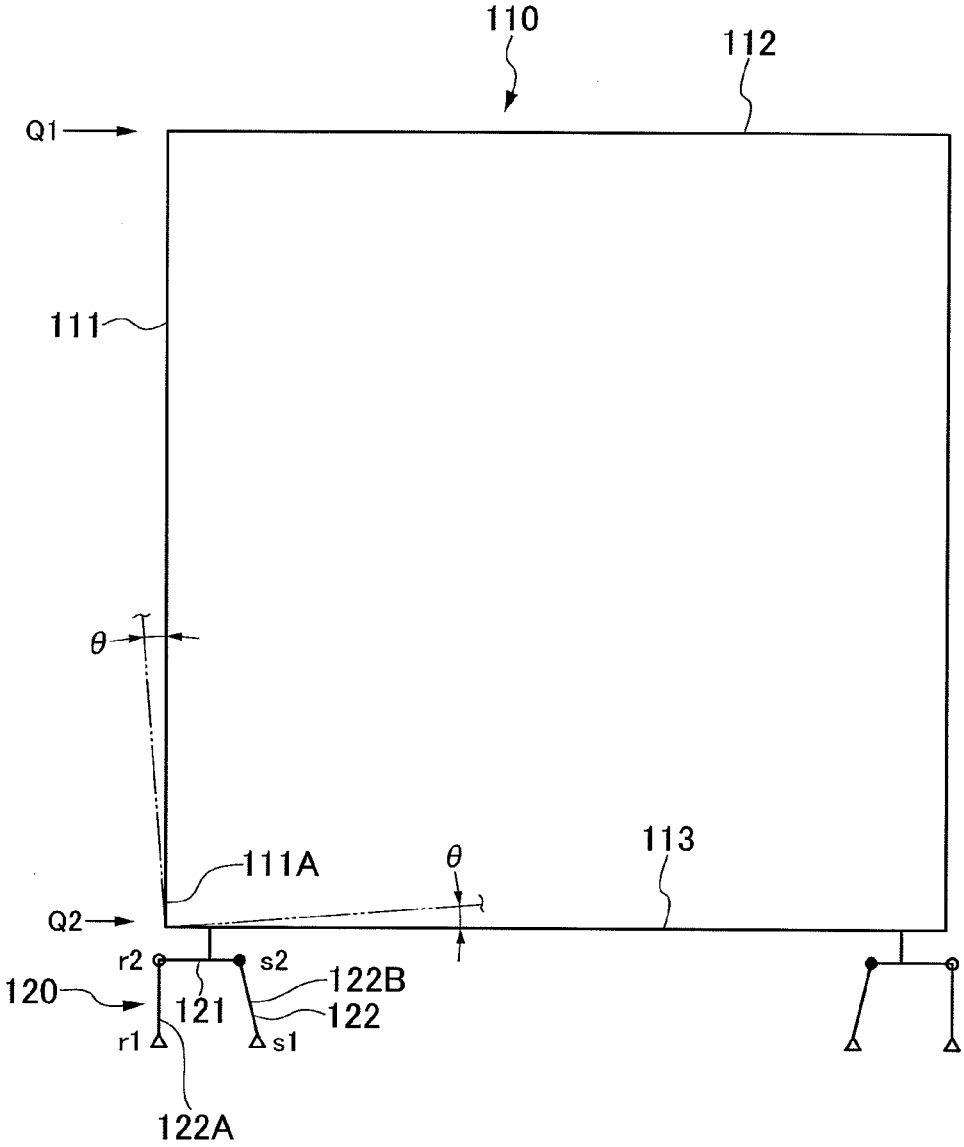
FIG. 20 is a schematic view showing horizontal force exerting on a column base joint connection.

As shown in FIG. 20, the column base joint trestle 120A is a cross member in which the coupling member 121 is reinforced by shape steels and reinforced pieces; the rod 122A is a vertical member made of square steel pipe; and the rod 122B is a diagonal member reinforced by shape steels and reinforced pieces. There are provided a joint point r1 of the lower end of the rod 122A and the foundation 114, a joint point r2 of the upper end of the rod 122A and one end of the coupling member 121, a joint point s1 of the lower end of the rod 122B and the foundation 114, and a joint point s2 of the upper end of the rod 122B and the other end of the coupling member 121. At least one of the four joint points r1, r2, s1, and s2 is a rigid joint point, and the remaining joint points are pin joint points. In the present embodiment, s2 is the rigid joint point; and r1, r2, and s1 are the pin joint points.

The column base joint trestle 120A forms the column base joint connection 120 as follows. The long-side (the short-side is also the same) will be described below.

(1) The column base joint trestle 120A is placed on the foundation 114, and a pair of rods 122 combined of two rods 122A and 122B is provided between the foundation 114 and the coupling member 121. The two rods 122A and 122B each have their lower end (r1 and s1) pin-jointed (applicable even in a rigid joint) to the foundation 114 by anchor bolts 123 and 124; the upper end (r2) of the rod 122A is pin-jointed (applicable even in the rigid joint) to the coupling member 121 by welding (welding length is short); and the upper end (s2) of the rod 122B is rigidly joined to the coupling member 121 by welding (welding length is long). An upper interval between the two rods 122A and 122B is narrower than a lower interval therebetween (the rods 122A and 122B are formed in a truncated chevron shape with each other, and the upper interval on the column 111 side is made narrower than the lower interval on the foundation 114 side). In the present embodiment, the rod 122A on the shear forward side, along a direction of horizontal shear force Q1 exerted on the column 111, is vertically arranged, and the rod 122B of the shear backward side is tilted forward.

(2) The building structure 110 is placed on joint portions of the coupling member 121 and the rods 122A and 122B of the column base joint trestle 120A. In the present embodiment, a lower end plate 111B of the column base 111A is placed on an upper end plate 131 of the rod 122A; and a lower surface 113B on the free end side of the joint piece 113A is placed on an upper end plate 132 of the rod 122B. At this time, an outside measurement distance L between the column base 111A and the joint piece 113A of the building structure 110 is made small as compared with an outside measurement distance K between the upper end plate 131 of the rod 122A and the upper end plate 132 of the rod 122B. In addition, the upper end plate 131 of the rod 122A and the upper end plate 132 of the rod 122B are located at the same level surface, and an upper surface of the coupling member 121 is lower than their level surface by a gap G; as a result, the gap G is formed between the upper surface of the coupling member 121 and the lower surface of the joint piece 113A.

(3) A bolt 141 is passed through the upper end plate 131 of the rod 122A via a washer 141A, and is fixed to a fixing block 141B that is welded to the backside of the lower end plate 111B of the column base 111A.

(4) A bolt 142 is passed through the joint piece 113A that is rigidly joined to the column base 111A of the column 111, the floor beam 113 in the joint piece 113A, and the coupling member 121 via a plate washer 142A; and a nut 142B is fixed on the backside of the coupling member 121. This rigidly joints the coupling member 121 made of a cross member to the column base 111A (joint piece 113A) of the column 111.

Figure 15:
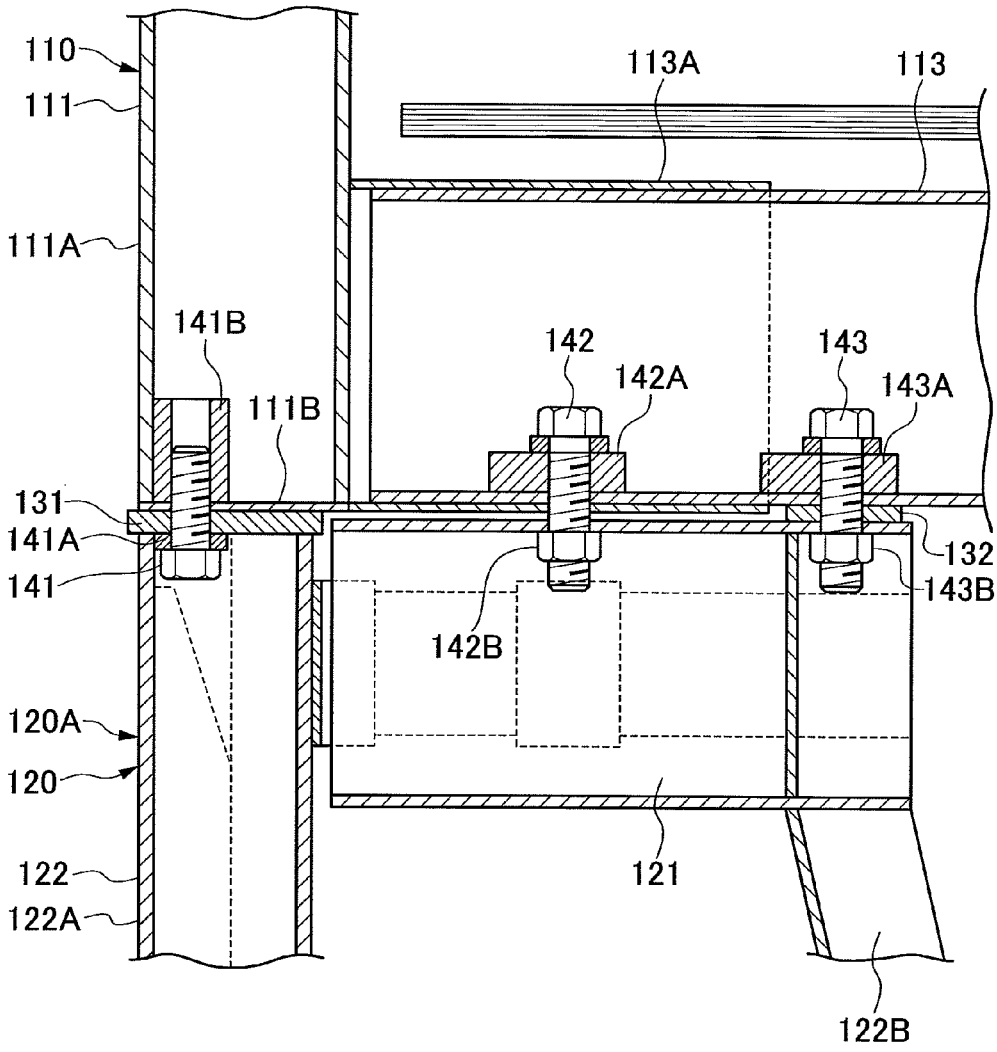
FIG. 15 is a schematic view showing a variant of FIG. 13.
Figure 16A:
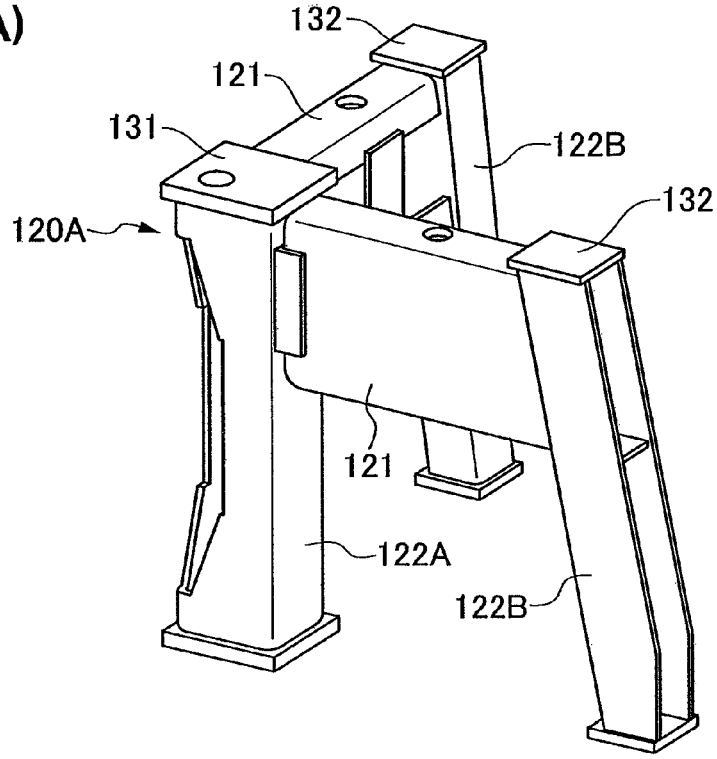
FIGS. 16(A)-16(B) show a column base joint trestle.
Figure 16B:
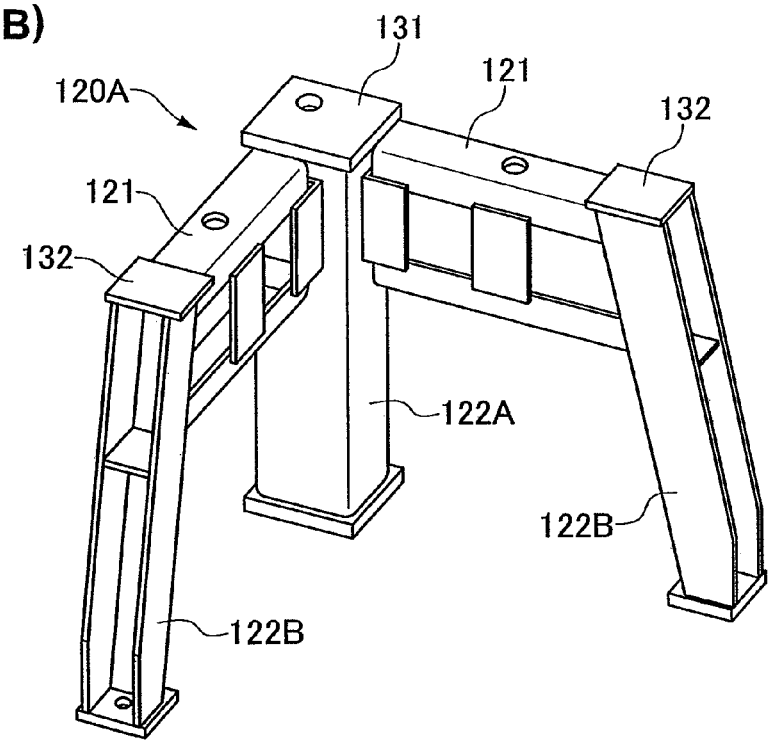
Figure 17:
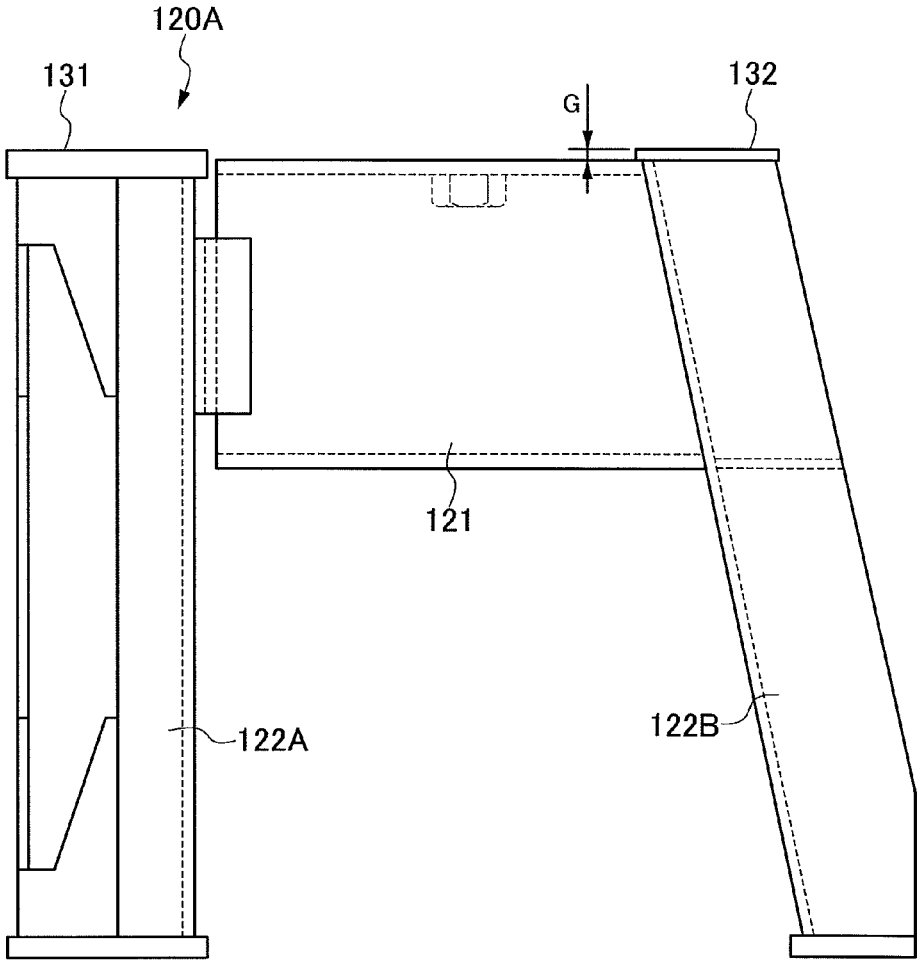
FIG. 17 is an external view showing the column base joint trestle.
Figure 18:
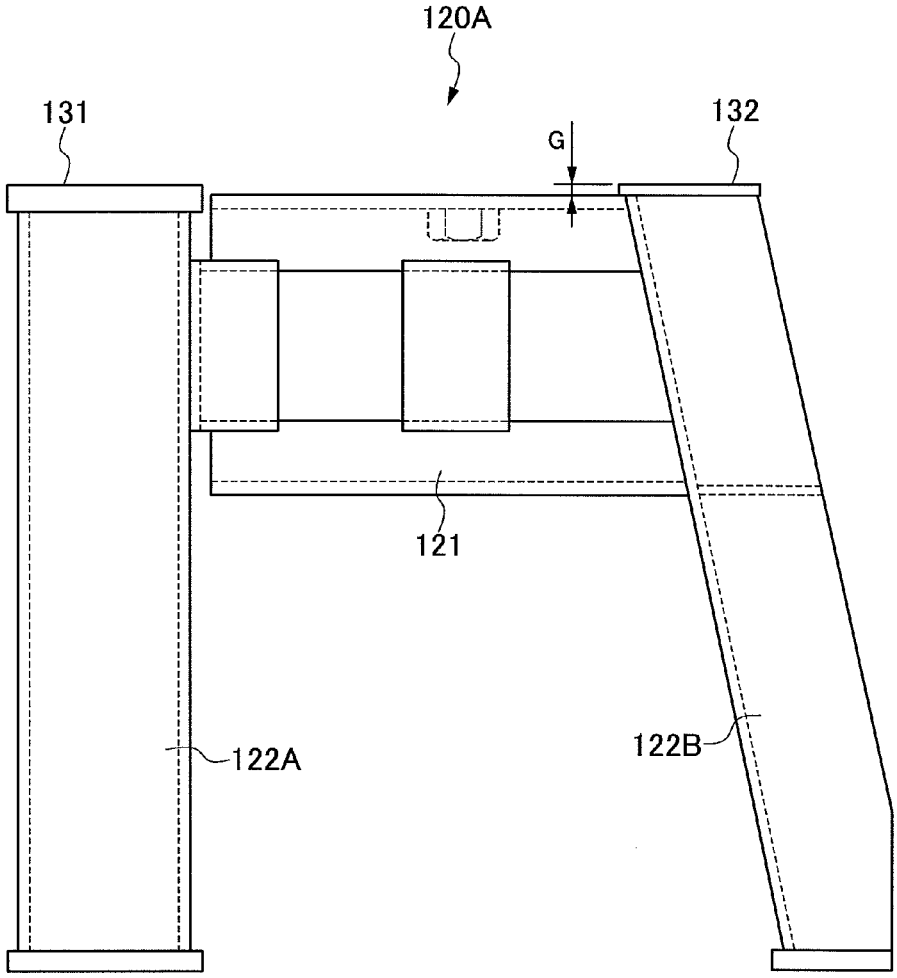
FIG. 18 is an internal view showing the column base joint trestle.
Figure 19:
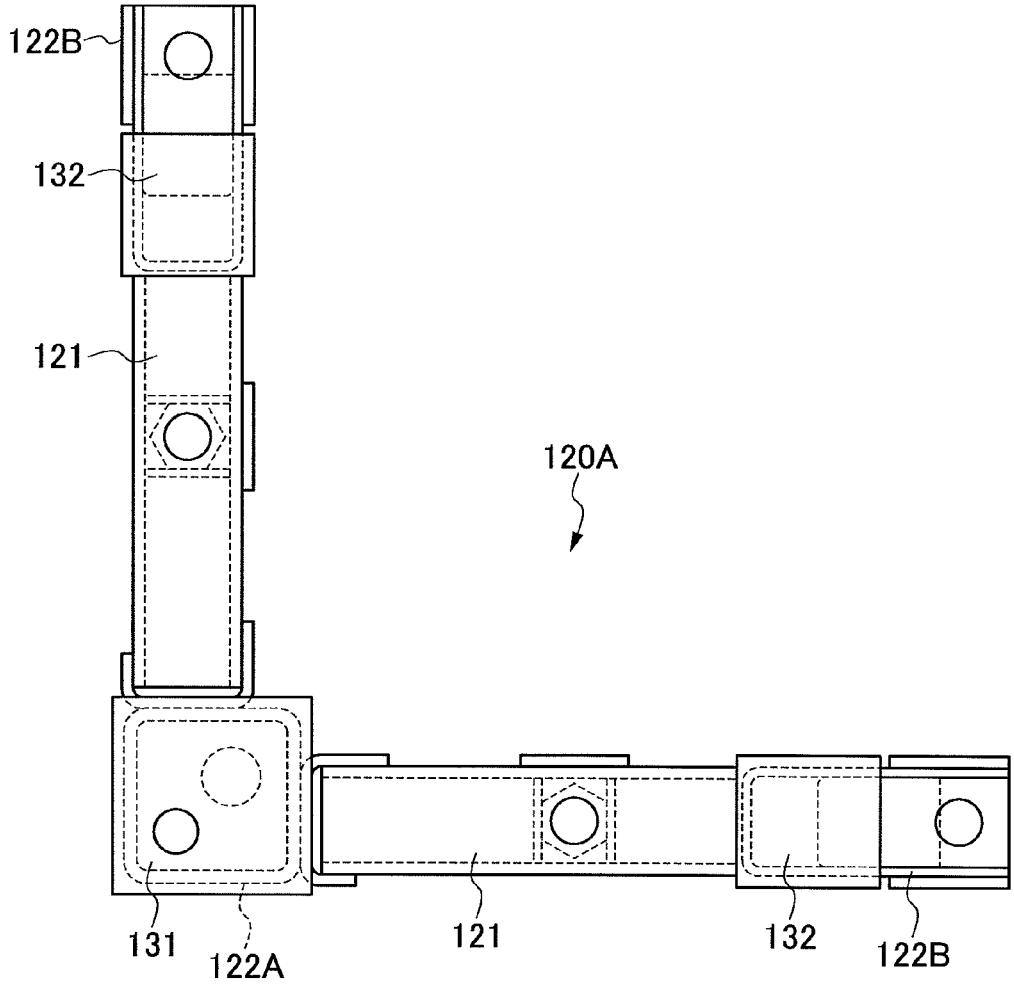
FIG. 19 is a plan view showing the column base joint trestle.

In addition, in the column base joint connection 120 of the column base joint trestle 120A, as shown in FIG. 15, a bolt 143 may be passed through a plate washer 143A, the floor beam 113 that is rigidly joined to the column base 111A of the column 111 via the joint piece 113A, the upper end plate 132 of the rod 122B; and a nut 143B may be fixed on the backside of the upper end plate 132. The rod 122B and the building structure 110 can be solidly joined.

Figure 21:
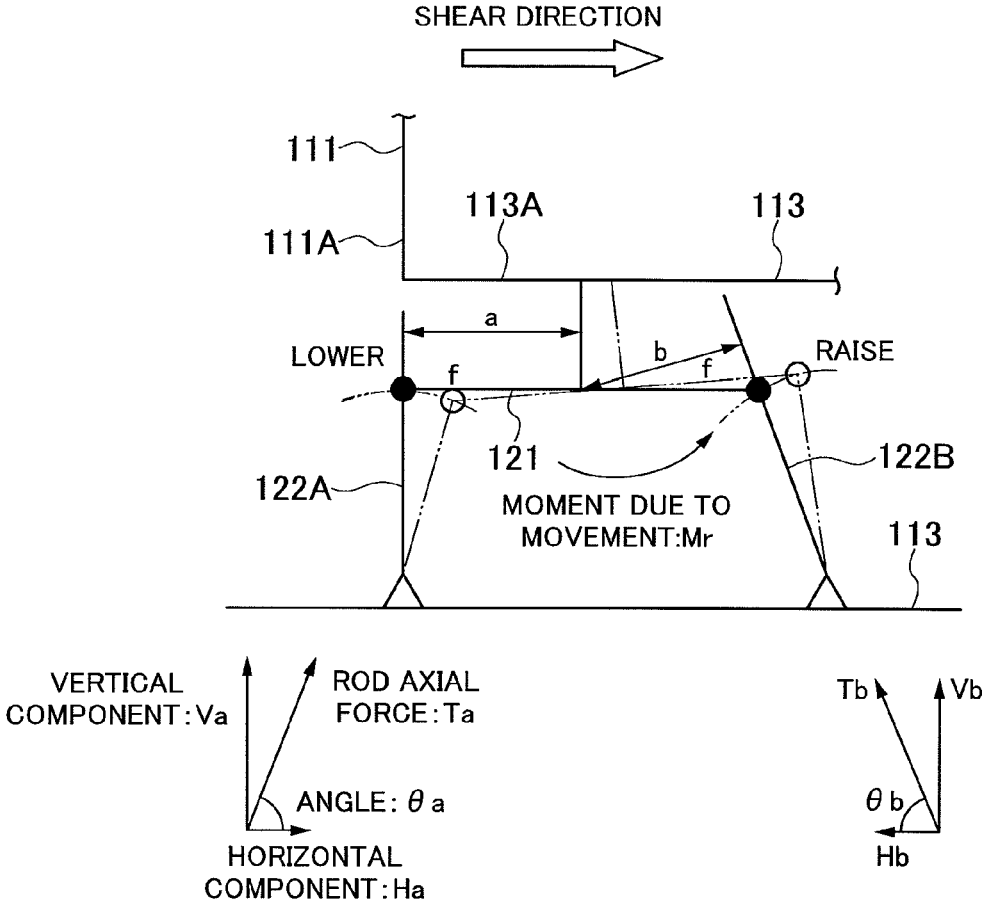
FIG. 21 is a schematic view showing a bending moment exerting on the column base joint connection.

A supporting mechanism of the building structure 110 will be described below (FIGS. 20 and 21).

(1) The horizontal shear force Q1 is exerted on the column 111. Further, in the present embodiment, the horizontal shear force Q2 (wall load, wind pressure, and the like corresponding to lower half of the column 111), in the same direction as that of the shear force Q1 exerted on the column 111, is exerted on the coupling member 121. In addition, the shear forces Q1 and Q2 are shear forces virtually exerted on one column.

At this time, supporting point reaction force Q=Q1+Q2 is exerted on joint portions of the two rods 122A and 122B to the foundation 114.

(2) A bending moment Mc due to the shear force Q1 exerted on the column 111 is generated in the column base 111A (a rigid joint point with the coupling member 121).

(3) Axial forces Ta and Tb are generated in the respective rods 122A and 122B by the supporting point reaction force Q(Q1+Q2) exerted on the two rods 122A and 122B. In addition, the axial forces Ta and Tb are generated when the coupling member 121 is made to move towards the same shear direction by the shear forces Q1 and Q2 exerted on the column 111.

Then, a bending moment Mr due to the axial forces Ta and Tb of the two rods 122A and 122B is generated at the column base 111A (the rigid joint point with the coupling member 121). The bending moment Mr is in a reverse direction to that of the bending moment Mc. The bending moment Mr lowers the upper end of the rod 122A on the shear forward side, and raises the upper end of the rod 122B on the shear backward side, so that the coupling member 121 is slightly rotated.

The following equations (1) to (5) are formed when horizontal components of the axial forces Ta and Tb are Ha and Hb, vertical components thereof are Va and Vb, arm lengths of the moments with respect to the column base 111A (the rigid joint point with the coupling member 121) of the axial forces Ta and Tb are a and b, a flange length from a joint point with the column base 111A to a joint point with the rod 122A in the coupling member 121 is f and a flange length therefrom to a joint point with the rod 122B is f, an intersecting angle made by the rod 122A with respect to the foundation 114 is θa (FIG. 21), and an intersecting angle made by the rod 122B with respect to the foundation 114 is θb (FIG. 21). In addition, the axial force of the column 111 is disregarded.

$$Q1+Q2=Ha+Hb \tag{1}$$

$$Va+Vb=0 \tag{2}$$

$$Mr=Ta\times a+Tb\times b \tag{3}$$

$$Mr=(Ha/\cos\theta a)\times a+(Hb/\cos\theta b)\times b \tag{4}$$

$$a=f\sin\theta a,\ b=f\sin\theta b \tag{5}$$

Therefore, in order to increase the bending moment Mr, there is required an increase in angles θa and θb of the rods 122A and 122B, an increase in the flange length f of the coupling member 121, or an increase in the shear force Q2 exerted on the coupling member 121.

The increase in the shear force Q2 exerted on the coupling member 121 can be realized by receiving a floor load and wind pressure by beam members and furring strips and transferring the same to the coupling member 121.

Furthermore, in the case where the joint of the rod 122A (122B) and the coupling member 121 or the foundation 114 is pin-jointed, resistance against movement of the coupling member 121 is small; therefore, the coupling member 121 is largely moved, and Mr can also be increased. In the case of the rigid joint, since the resistance against movement of the coupling member 121 is large, Mr is small as compared with the pin joint; however, deformation of the rod 122A (122B) is very small, and therefore, generation of microvibration can be suppressed.

(4) In the case of Mr=Mc, the column base 111A is in a rigid joint state (the column base 111A does not rotate, and a relative angle between the column 111 and the foundation 114 is invariance).

(5) In the case of Mr>Mc, the column base 111A is moved back in a reverse direction to a deformation direction due to Mc. This is referred to as a super rigid joint state. The coupling member 121 moves to the shear direction (direction of Q1).

(6) In the case of Mr<Mc, the column base 111A is in a semi rigid joint state (weaker than the rigid joint). The coupling member 121 moves in a reverse direction to the shear direction.

According to the present embodiment, the following operation effects are achieved.

(a) The coupling member 121 is rigidly joined to the column base 111A, a pair of rods 122 comprised of two rods 122A and 122B is provided between the foundation 114 and the coupling member 121, the two rods 122A and 122B each have their lower end joined to the foundation 114 and their upper end joined to the coupling member 121, and the upper interval between the two rods 122A and 122B is narrower than the lower interval therebetween; accordingly, the axial forces Ta and Tb of the two rods 122A and 122B exert the bending moment Mr on the coupling member 121, and the bending moment Mr reduces deformation of the column 111 (displacement of the intersecting angle between the column 111 and the foundation) and operates so as to minimize deformation of the entire building.

(b) The coupling member 121 is made of a cross member; therefore, the coupling member 121 can be high stiffness as compared with a flange in which the coupling member 121 is joined to the column base 111A and the floor beam. Therefore, the above described (a) bending moment Mr, which the axial forces Ta and Tb of the two rods 122A and 122B exert on the coupling member 121, is stably transferred to the column base 111A; consequently, this can be balanced out with the bending moment Mc generated in the column base 111A. With this configuration, deformation of the entire building can be stably minimized.

(c) The length of the coupling member 121 made up of the cross member can be lengthened irrespective of a position of the rigid joint point of the coupling member 121 fixed to the column base 111A (including the floor beam joint piece 113A welded to the column base 111A). This means that the flange length f from the above described rigid joint point of the coupling member 121 and the column base 111A to the joint point of the coupling member 121 and the rod 122B can be lengthened; therefore, the previously described (a) bending moment Mr, which the axial forces Ta and Tb of the two rods 122A and 122B exert on the coupling member 121, can be increased (the reason is previously described). With this configuration, deformation of the entire building can be surely minimized.

(d) Variation in the shear force Q2 exerted on the coupling member 121 can be avoided by rigidly joining the coupling member 121 (cross member) and the upper ends of the rods (diagonal member 122B and/or vertical member 122A). The joint point r1 of the lower end of one rod 122A and the foundation 114, the joint point r2 of the upper end of the rod 122A and the coupling member 121 (cross member), the joint point s1 of the lower end of the other one rod 122B (diagonal member) and the foundation 114, and the joint point s2 of the upper end of the rod 122B and the coupling member 121 (cross member) will be considered. At this time, if all the r1, r2, s1, and s2 are pin joints, the previously described (a) bending moment Mr, which the axial forces Ta and Tb of the two rods 122A and 122B exert on the coupling member 121, becomes large; the strength of the building structure 110 is largely dependent on a ratio between the shear force Q1 exerted on the column 111 and the above described Q2, and the strength of the building structure 110 cannot be preliminarily specified. On the other hand, if the coupling member 121 (cross member) and the upper ends (r2 and/or s2) of the rods (diagonal member 122B and/or vertical member 122A) are rigidly joined, the bending moment Mr does not become large to the extent mentioned above, the difference in the strength of the building structure 110 due to the ratio between Q1 and Q2 is almost eliminated, and the strength of the building structure 110 can be preliminarily specified without depending on plans.

(e) When the building structure 110 is placed on rigid joint portions of the above described (d) coupling member 121 (cross member) and the rods (the diagonal member 122B and/or the vertical member 122A), a degree of fixation of the building structure 110 (of the floor beam 113) can be strengthened. When the previously described (a) bending moment Mr, which the axial forces Ta and Tb of the two rods 122A and 122B exert on the coupling member 121, is transferred to the column base 111A (floor beam) of the building structure 110, a distance between the column 111 of the building structure 110 and a bearing supporting point (placing point) to the coupling member 121 of the building structure 110 becomes large, and the supporting point reaction force is reduced (in this regard, however, when the bending moment Mr is not bearing the weight of the building structure 110, but, pull-out force is exerted on the supporting point, there is no effect of the reduction in the supporting point reaction force, and consequently, the reaction force is exerted on other beam fixing bolt).

(f) When the shear force exerts on the column 111 of the building structure 110 and the axial forces Ta and Tb are generated in the two rods 122A and 122B, the bending moment Mr generated in the column base 111A due to the axial forces Ta and Tb of the two rods 122A and 122B is in a reverse direction to the bending moment Mc generated in the column base 111A due to the shear force exerting on the column 111. Therefore, deformation of the column 111 due to the bending moment Mc and deformation of the column 111 due to the bending moment Mr are balanced out with each other, deformation of the column 111 is reduced, and deformation of the entire building is minimized.

(g) As described above in (a) and (f), the deformation of the column 111 can be reduced by the bending moments Mr and Mc exerted on the coupling member 121; therefore, the lower end of the two rods 122A and 122B are not rigidly joined to the foundation 114, but, deformation of the column 111 is reduced even in the case of pin-jointing, and deformation of the entire building can be minimized.

(h) When the bending moment Mr and the bending moment Mc are set to Mr=Mc, the column base 111A is in a rigid joint state with respect to the foundation 114 (the column base 111A does not rotate, and the intersecting angle between the column 111 and the foundation is not displaced), and deformation of the column 111 can be reduced.

(i) When the bending moment Mr and the bending moment Mc are set to Mr>Mc, the column base 111A has deformation due to Mc, which is moved back in a reverse direction by Mr, and becomes in a super rigid joint state, so that deformation of the column 111 can be reduced as compared with the above mentioned (d). The coupling member 121 moves in the shear direction.

(j) When the shear force Q2 having the same direction as the shear force Q1 exerted on the column 111 is exerted on the coupling member 121, supporting point reaction force Q=Q1+Q2, which the foundation 114 exerts on the two rods 122A and 122B, is increased; therefore, the axial forces Ta and Tb of the two rods 122A and 122B are increased, the bending moment Mr is increased, and effect due to providing the two rods 122A and 122B can be further improved.

(k) The above mentioned (a) to (j) can be realized in the joint connection 120 in which the lower structure is the foundation 114 and the column 111 of the building structure 110 is joined to the foundation 114.

Embodiment 9

FIG. 22

Figure 22:
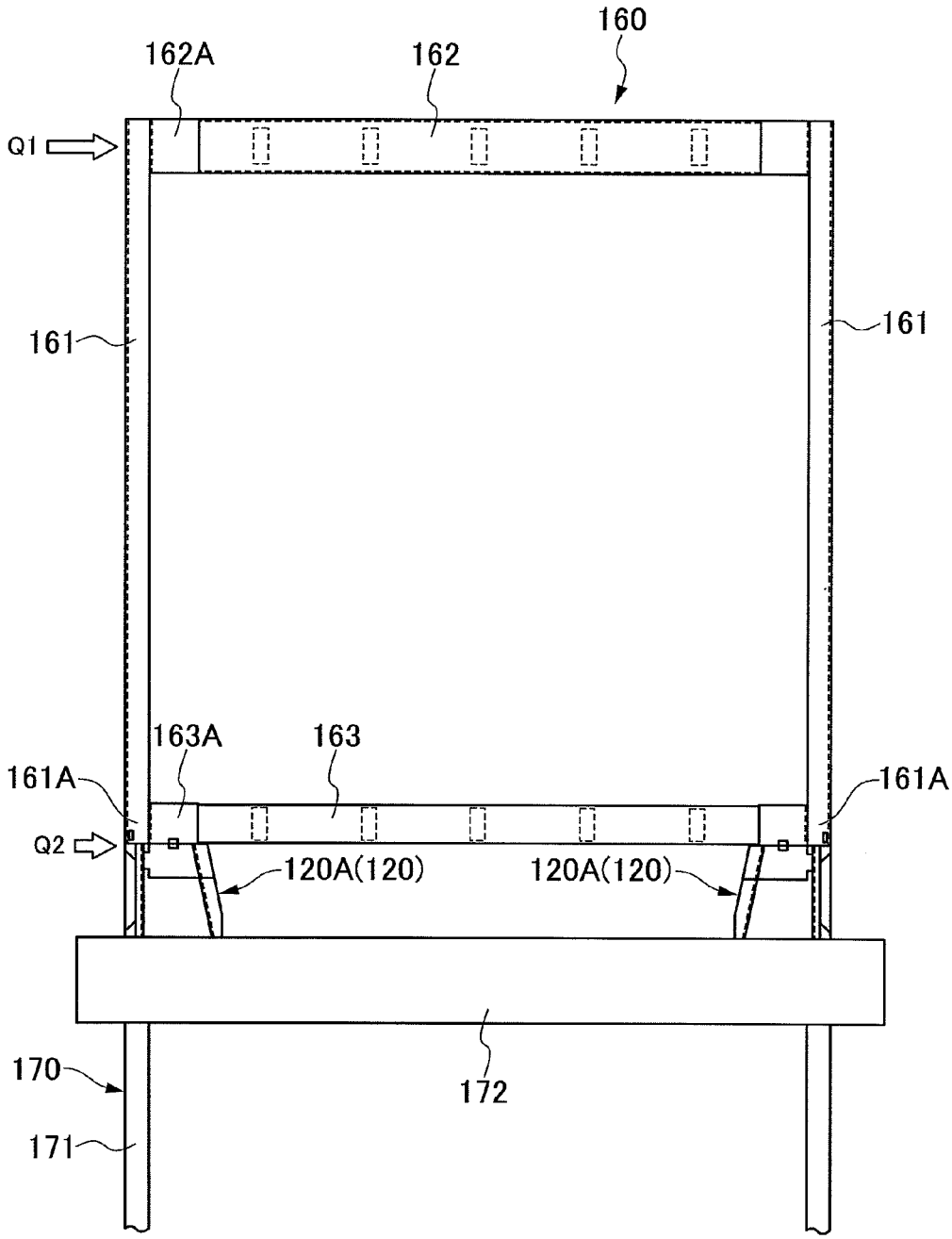
FIG. 22 is a schematic view showing a frame structure of an embodiment 9.
Figure 23:
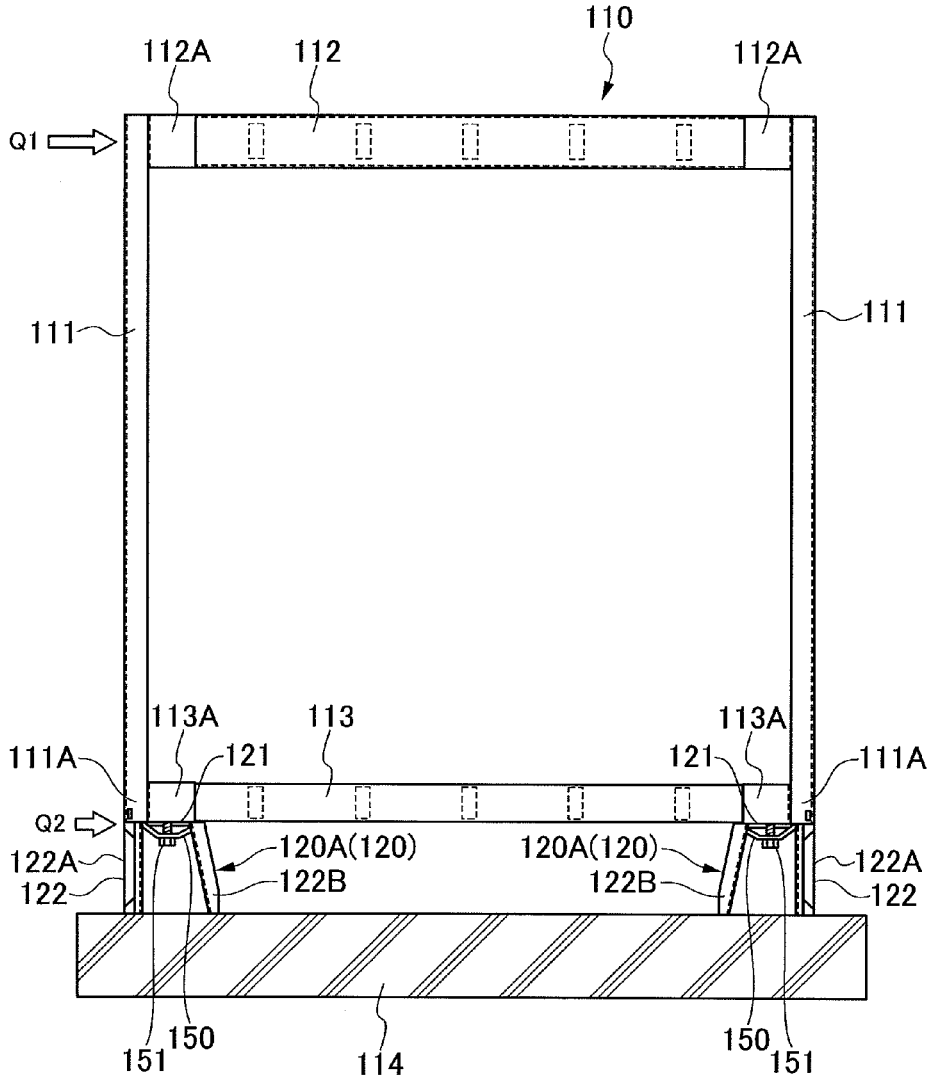
FIG. 23 is a schematic view showing a building structure of an embodiment 10.

As shown in FIG. 22, a building structure 160 is of a frame structure of a rectangular box frame structure. In each of the long-sides and short-sides that are mutually orthogonal as seen from the top, a ceiling beam 162 is rigidly joined to joint pieces 162A that are rigidly joined to the upper ends of mutually parallel arranged columns 161 and 161; accordingly, the upper ends of the columns 161 and 161 are coupled. At the same time, a floor beam 163 (horizontal member) is rigidly joined to joint pieces 163A that are rigidly joined to the lower ends (column base 161A) of the mutually parallel arranged columns 161 and 161; accordingly, the lower ends of the columns 161 and 161 are coupled.

In each of the long-sides and short-sides, the building structure 160 has respective column bases 161A of the columns 161 and 161, each of the column bases 161A being joined to a lower story structure 170 (lower structure) by the column base joint connection 120 of the column base joint trestle 120A of the embodiment 8.

The lower story building structure 170 is of a frame structure in which columns 171 and a beam 172 are rigidly joined, and the column base 161A of the column 161 of the upper story building structure 160 is joined to the beam 172 by the column base joint connection 120.

A supporting mechanism of the building structure 160 is substantially the same as the supporting mechanism of the building structure 110. Therefore, when shear force Q1 is exerted on the column 161 of the building structure 160 and axial forces Ta and Tb are generated in two rods 122A and 122B, and as a result, a coupling member 121 is moved in the same shear direction by the shear force Q1, a bending moment Mr generated in the column base 161A (a rigid joint point with the coupling member 121) due to the axial forces Ta and Tb of the two rods 122A and 122B is in a reverse direction to a bending moment Mc generated in the column base 161A (the rigid joint point with the coupling member 121) due to the shear force Q1 exerting on the column 161. In addition, shear force Q2 (wall load, wind pressure, and the like corresponding to lower half of the column 161) in the same direction as that of the shear force Q1 exerted on the column 161 is exerted on the coupling member 121.

According to the present embodiment, substantially the same operation effects as the embodiment 1 are achieved.

Embodiment 10

FIGS. 23 to 26

A column base joint connection 120 of a column base joint trestle 120A of an embodiment 10 is different from that of the embodiment 8 in the following points.

That is, as shown in FIGS. 23 to 26, in the column base joint trestle 120A of the embodiment 10, a coupling member 121 is a cross member made of steel plate, a rod 122A is a vertical member made of square steel pipe, and a rod 122B is a diagonal member made of shape steel.

Then, the column base joint trestle 120A of the embodiment 10 forms the column base joint connection 120 as follows (see FIGS. 20 and 21). The long-side (the short-side is also the same) will be described below.

(1) The column base joint trestle 120A is placed on a foundation 114, and a pair of rods 122 combined of two rods 122A and 122B is provided between the foundation 114 and the coupling member 121. The two rods 122A and 122B each have their lower end (r1 and s1) pin-jointed (applicable even in a rigid joint) to the foundation 114 by anchor bolts 123 and 124; the upper end (r2) of the rod 122A is pin-jointed (applicable even in the rigid joint) to the coupling member 121 by welding (welding length is short); and the upper end (s2) of the rod 122B is rigidly joined to the coupling member 121 by welding (welding length is long). An upper interval between the two rods 122A and 122B is narrower than a lower interval therebetween (the rods 122A and 122B are formed in a truncated chevron shape with each other, and the upper interval on the column 111 side is made narrower than the lower interval on the foundation 114 side). In the present embodiment, the rod 122A on the shear forward side along a direction of horizontal shear force Q1 exerted on the column 111 is vertically arranged, and the rod 122B on the shear backward side is tilted forward.

(2) A building structure 110 is placed on joint portions of the coupling member 121 and the rods 122A and 122B of the column base joint trestle 120A. In the present embodiment, a lower end plate 111B of a column base 111A is placed on an upper end plate 131 of the rod 122A; and a lower surface 113B on the free end side of a joint piece 113A is placed on an upper end plate 132 of the rod 122B. At this time, an outside measurement distance L between the column base 111A and the joint piece 113A of the building structure 110 is made small as compared with an outside measurement distance K between the upper end plate 131 of the rod 122A and the upper end plate 132 of the rod 122B. In addition, the upper end plate 131 of the rod 122A and the upper end plate 132 of the rod 122B are located at the same level surface, and an upper surface of the coupling member 121 is lower than their level surface by a gap G; s a result, the gap G is formed between the upper surface of the coupling member 121 and the lower surface of the joint piece 113A.

(3) A bolt 141 is passed through the upper end plate 131 of the rod 122A via a washer 141A, and is fixed to a fixing block 141B that is welded to the backside of the lower end plate 111B of the column base 111A.

(4) The coupling member 121 is tensionally joined to a beam member 113 that is rigidly joined to the column base 111A of the column 111. Specifically, a resilient bridging member 150 is provided on the opposite side (backside) with respect to the column base 111A (joint piece 113A) in the coupling member 121 that is tensionally joined to the column base 111A (including the floor beam joint piece 113A welded to the column base 111A) of the column 111. The resilient bridging member 150 is formed in a V shape. The one end of the resilient bridging member 150 is supported by being welded to the upper end plate 131 of the rod 122A, and the other end of the resilient bridging member 150 is supported by being welded to the upper end side of the rod 122B. An intermediate portion of the resilient bridging member 150 is separated from the backside of the coupling member 121 to form a rational cross section with small deformation. A bolt 151 passes through an intermediate portion of the resilient bridging member 150, an intermediate portion of the coupling member 121, the joint piece 113A rigidly joined to the column base 111A of the column 111, and the floor beam 113 in the joint piece 113A via a washer 151A; and a nut 151B is fixed on the inner surface side of the floor beam 113. The bolt 151 can be a high strength bolt. Tensile force introduced to the bolt 151 becomes a resistance force (tear-off resistance force) against a tear-off force that tears off the column base 111A from the coupling member 121, and the column base 111A and the coupling member 121 are joined so as to resiliently pull.

A supporting mechanism according to the column base joint connection 120 of the building structure 110 of the embodiment 10 is substantially the same as the supporting mechanism of the column base joint connection 120 of the embodiment 8. Therefore, when shear force Q1 is exerted on the column 111 of the building structure 110 and axial forces Ta and Tb are generated in the two rods 122A and 122B, and as a result, a coupling member 121 is moved in the same shear direction by the shear force Q1, a bending moment Mr generated in the column base 111A (a tensile joint point with the coupling member 121), due to the axial forces Ta and Tb of the two rods 122A and 122B, is in a reverse direction to a bending moment Mc generated in the column base 111A (the tensile joint point with the coupling member 121), due to the shear force Q1 exerting on the column 111. In addition, shear force Q2 (wall load, wind pressure, and the like corresponding to lower half of the column 111) in the same direction as that of the shear force Q1 exerted on the column 111 is exerted on the coupling member 121.

Figure 24:
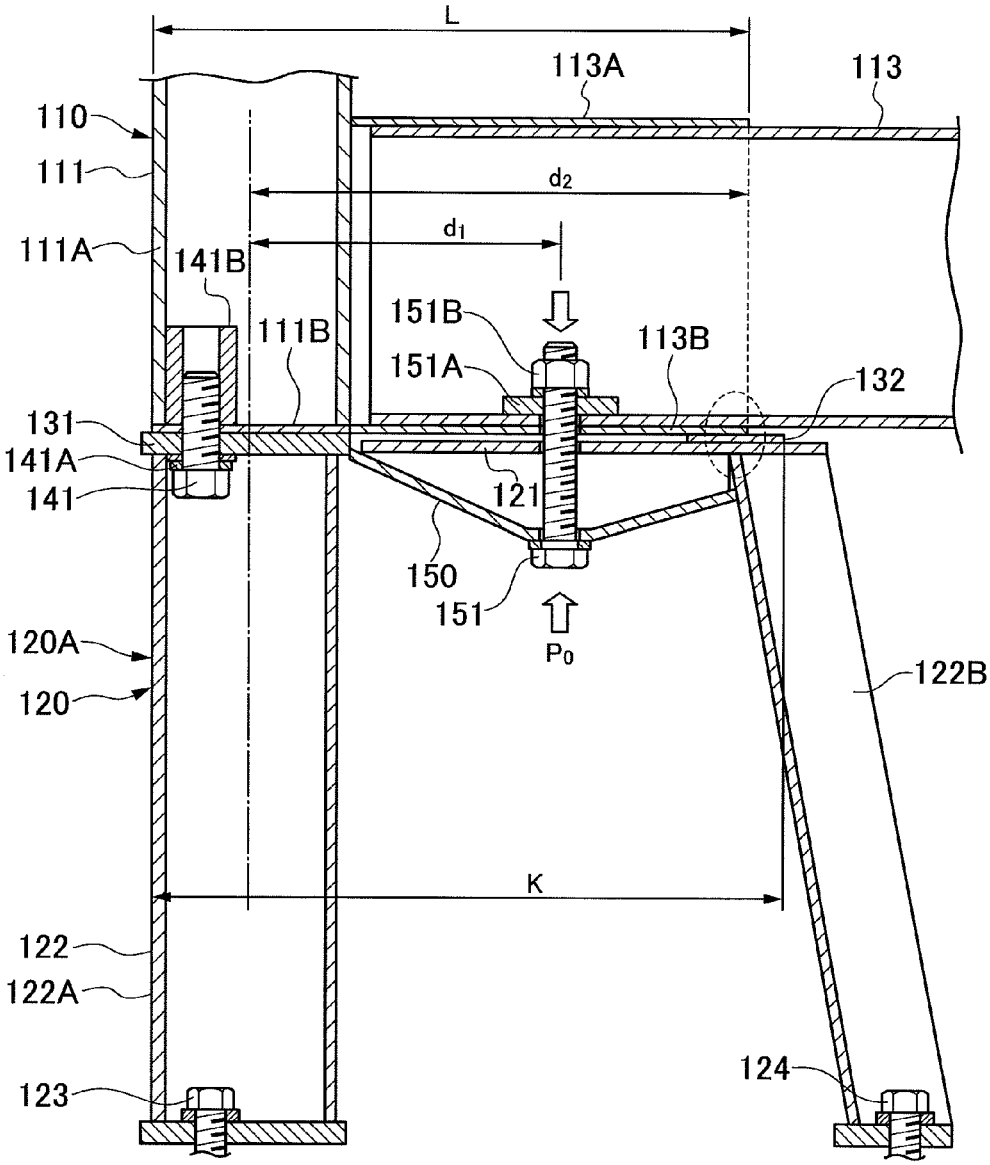
FIG. 24 is a relevant part enlarged view of FIG. 23.
Figure 25:
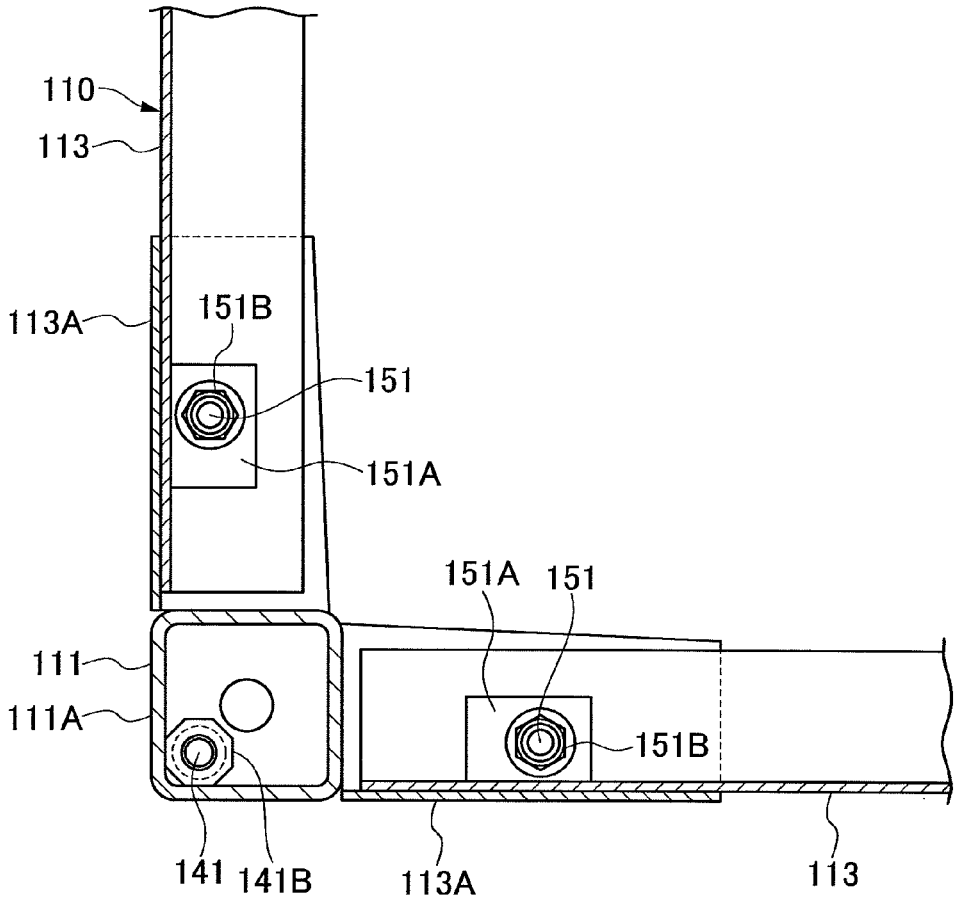
FIG. 25 is a plan view of FIG. 24.
Figure 26:
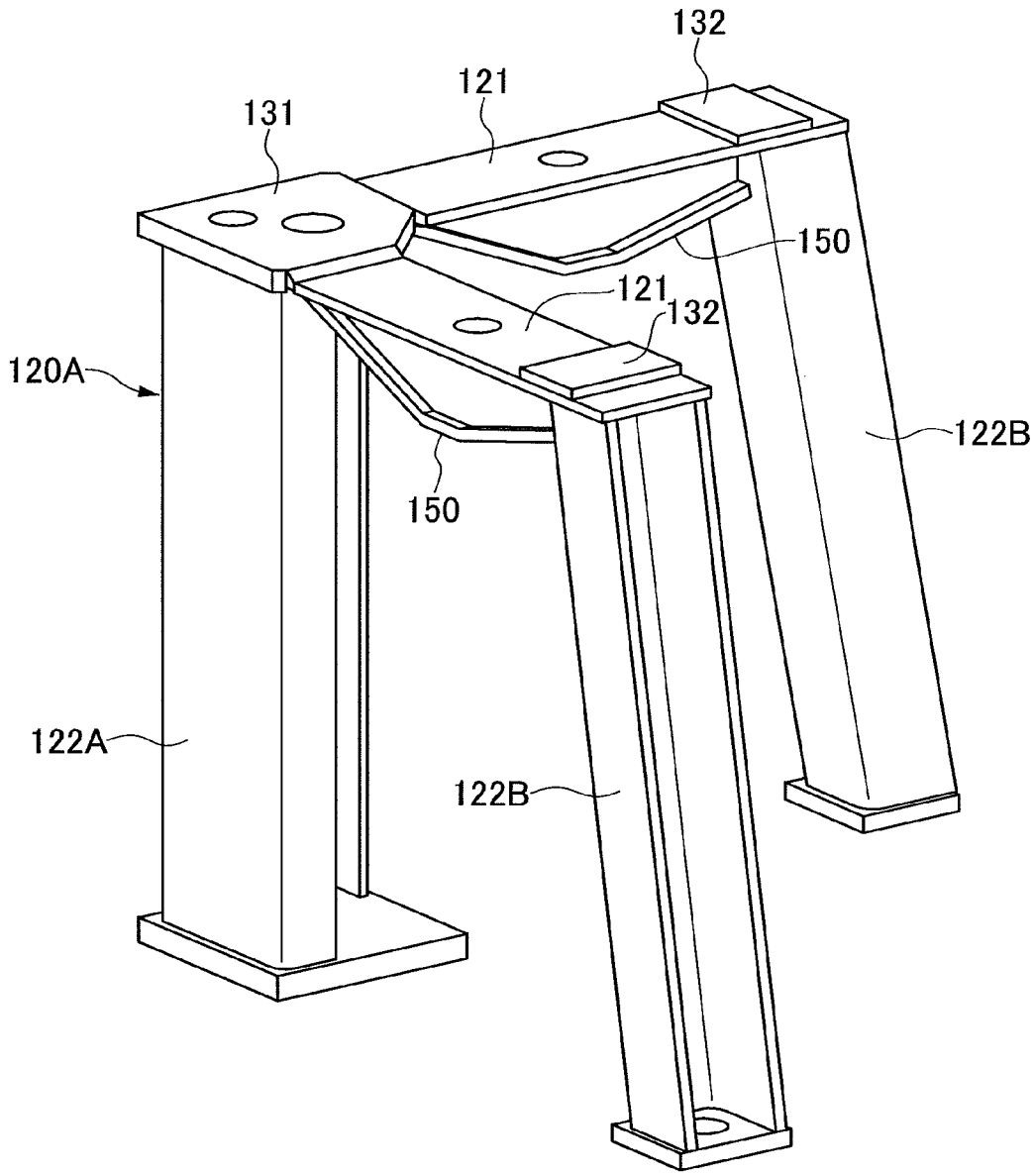
FIG. 26 a perspective view showing a column base joint trestle.

A tear-off prevention mechanism with respect to the column base joint trestle 120A of the building structure 110 characteristic of the embodiment 10 will be described below (FIG. 24).

(1) An introduction tensile force P0 is introduced to the bolt 151 in which the resilient bridging member 150 attached on the backside of the base member 121 and the column base 111A (joint piece 113A) of the column 111 are tensionally joined.

(2) When a distance between the bolt 151 and the column 111 is d1 and a distance between a contact point of the column base 111A (joint piece 113A) and the base member 121 (upper end plate 132) and the column 111 is d2, a tear-off resistance force F is generated at the contact point of the column base 111A (joint piece 113A) and the base member 121 (upper end plate 132). The tear-off resistance force F makes the building structure 110 rotate with respect to the column base joint trestle 120A due to a lateral force P (FIG. 5) exerted on the building structure 110. The tear-off resistance force is a resistance force against the tear-off force that tears off the column base 111A of the building structure 110 from the base member 121 of the column base joint trestle 120A, and is F=P0×(d1/d2); for example, F is F=1.22 tons provided that P0, d1, and d2 are set: P0=1.97 tons, d1=155 mm, and d2=250 mm.

(3) The column base 111A is not torn off from the base member 121 until the tear-off force exerting on the contact point of the column base 111A (joint piece 113A) and the base member 121 (upper end plate 132) due to the lateral force P exceeds the tear-off resistance force F.

According to the present embodiment, the following operation effects are achieved in addition to the operation effects of the embodiment 8.

(a) The coupling member 121 is tensionally joined to the column base 111A, a pair of rods 122 combined of two rods 122A and 122B is provided between the foundation 114 and the coupling member 121, the two rods 122A and 122B each have their lower end joined to the foundation 114 and their upper end joined to the coupling member 121, and the upper interval between the two rods 122A and 122B is narrower than the lower interval therebetween; accordingly, the axial forces Ta and Tb of the two rods 122A and 122B exert the bending moment Mr on the coupling member 121, and the bending moment Mr reduces deformation of the column 111 (displacement of the intersecting angle between the column 111 and the foundation) and operates so as to minimize deformation of the entire building.

(b) Tensile force tensionally jointing the coupling member 121 to the column base 111A is introduced between the column base 111A and the coupling member 121. As a result, the introduction tensile force becomes a resistance force (tear-off resistance force) against the tear-off force that tears off the column base 111A from the coupling member 121; rotation of the building structure 110 with respect to the coupling member 121 (rotation θ of the column 111 with respect to a vertical line, and rotation θ of the floor beam 113 with respect to a horizontal line shown in FIG. 20) is reduced; and deformation of the entire building can be stably minimized.

(c) The length of the coupling member 121 made of the cross member can be lengthened irrespective of a position of the tensile joint point of the coupling member 121 fixed to the column base 111A (including the floor beam joint piece 113A welded to the column base 111A). This means that the flange length f from the above described tensile joint point of the coupling member 121 and the column base 111A to the joint point of the coupling member 121 and the rod 122B can be lengthened; therefore, the previously described (a) bending moment Mr, which the axial forces Ta and Tb of the two rods 122A and 122B exert on the coupling member 121, can be increased (the reason is previously described). With this configuration, deformation of the entire building can be surely minimized.

(d) Variation in shear force Q2 exerted on the coupling member 121 can be avoided by rigidly jointing the upper ends of the coupling member 121 (cross member) and the rods (diagonal member 122B and/or vertical member 122A). A joint point r1 of the lower end of one rod 122A and the foundation 114, a joint point r2 of the upper end of the rod 122A and the coupling member 121 (cross member), a joint point s1 of the lower end of the other one rod 122B (diagonal member) and the foundation 114, and a joint point s2 of the upper end of the rod 122B and the coupling member 121 (cross member) will be considered. At this time, if all the r1, r2, s1, and s2 are pin joints, the previously described (a) bending moment Mr, which the axial forces Ta and Tb of the two rods 122A and 122B exert on the coupling member 121, becomes large; however, the strength of the building structure 110 is largely dependent on a ratio between the shear force Q1 exerted on the column 111 and the above described Q2, and the strength of the building structure 110 cannot be preliminarily specified. On the other hand, if the coupling member 121 (cross member) and the upper ends (r2 and/or s2) of the rods (diagonal member 122B and/or vertical member 122A) are rigidly joined, the bending moment Mr does not become large to the extent mentioned above; however, the difference in the strength of the building structure 110 due to the ratio between Q1 and Q2 is almost eliminated, and the strength of the building structure 110 can be preliminarily specified without depending on plans.

(e) Both ends of the resilient bridging member 150 are supported to the coupling member 121 or the rods 122A and 122B, the intermediate portion of the resilient bridging member 150 is made apart from the coupling member 121, and the bolt 151 passing through the intermediate portion of the resilient bridging member 150 and the coupling member 121 is tensionally joined to the column base 111A of the column 111; and accordingly, the coupling member 121 can be tensionally joined to the column base 111A by a simple structure.

Embodiment 11

FIG. 27

Figure 27:
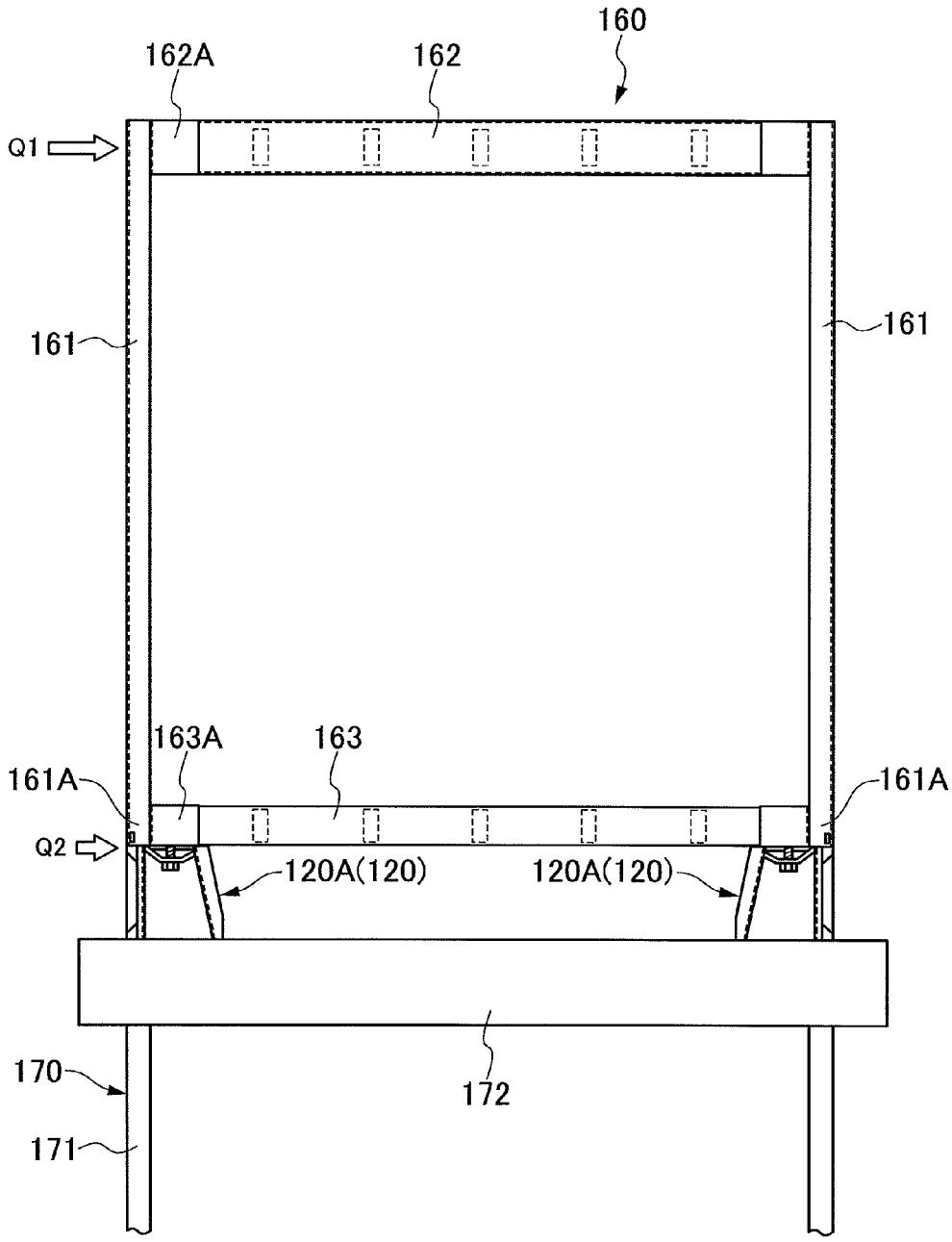
FIG. 27 is a schematic view showing a frame structure of an embodiment 11.

As shown in FIG. 27, a building structure (building unit) 160 is of a frame structure of a rectangular box frame structure. In each of the long-sides and short-sides that are mutually orthogonal as seen from the top, a ceiling beam 162 is rigidly joined to joint pieces 162A that are rigidly joined to the upper ends of mutually parallel arranged columns 161 and 161; accordingly, the upper ends of the columns 161 and 161 are coupled. At the same time, a floor beam 163 (horizontal member) is rigidly joined to joint pieces 163A that are rigidly joined to the lower ends (column base 161A) of the mutually parallel arranged columns 161 and 161; and accordingly, the lower ends of the columns 161 and 161 are coupled.

In each of the long-sides and short-sides, the building structure 160 has respective column bases 161A of the columns 161 and 161, each of the column bases 161A being joined to a lower story structure 170 (lower structure) by the column base joint connection 120 of the column base joint trestle 120A of the embodiment 8.

The lower story building structure 170 is of a frame structure in which columns 171 and a beam 172 are rigidly joined, and the column base 161A of the column 161 of the upper story building structure 160 is joined to the beam 172 by the column base joint connection 120.

A supporting mechanism of the building structure 160 is substantially the same as the supporting mechanism of the building structure 110. Therefore, when shear force Q1 exerted on the column 161 of the building structure 160 and axial forces Ta and Tb are generated in two rods 122A and 122B, and as a result, a coupling member 121 is moved in the same shear direction by the shear force Q1, a bending moment Mr generated in the column base 161A (a tensile joint point with the coupling member 121), due to the axial forces Ta and Tb of the two rods 122A and 122B, is in a reverse direction to a bending moment Mc generated in the column base 161A (the tensile joint point with the coupling member 121) due to the shear force Q1 exerted on the column 161. In addition, shear force Q2 (wall load, wind pressure, and the like corresponding to lower half of the column 161) in the same direction as that of the shear force Q1 exerted on the column 161 is exerted on the coupling member 121.

According to the present embodiment, substantially the same operation effects as the embodiment 1 are achieved.

Embodiment 12

Figure 28:
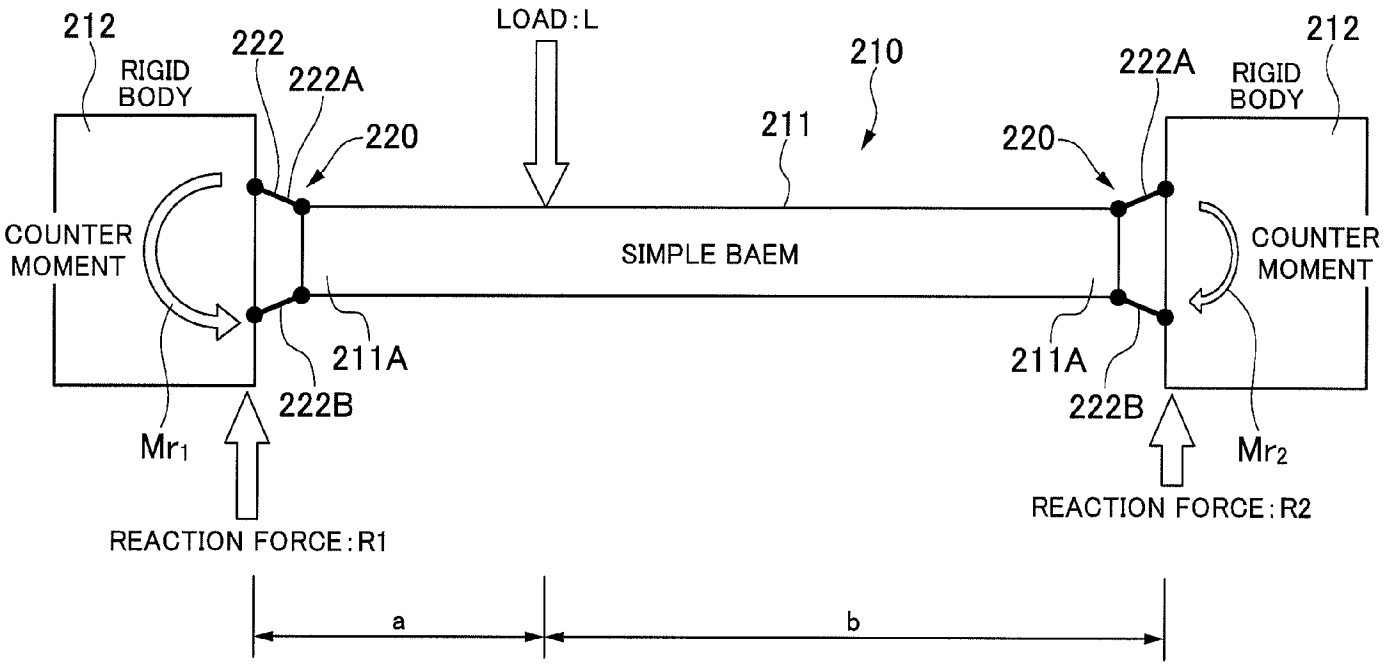
FIG. 28 is a schematic view showing a beam joint connection of an embodiment 12.
Figure 29:
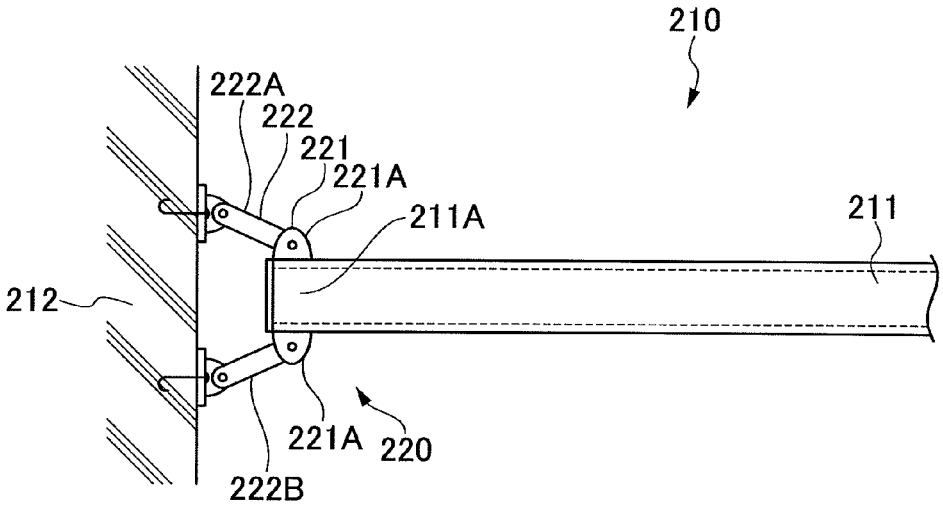
FIG. 29 is a schematic view showing a specific embodiment of the beam joint connection.
Figure 30:
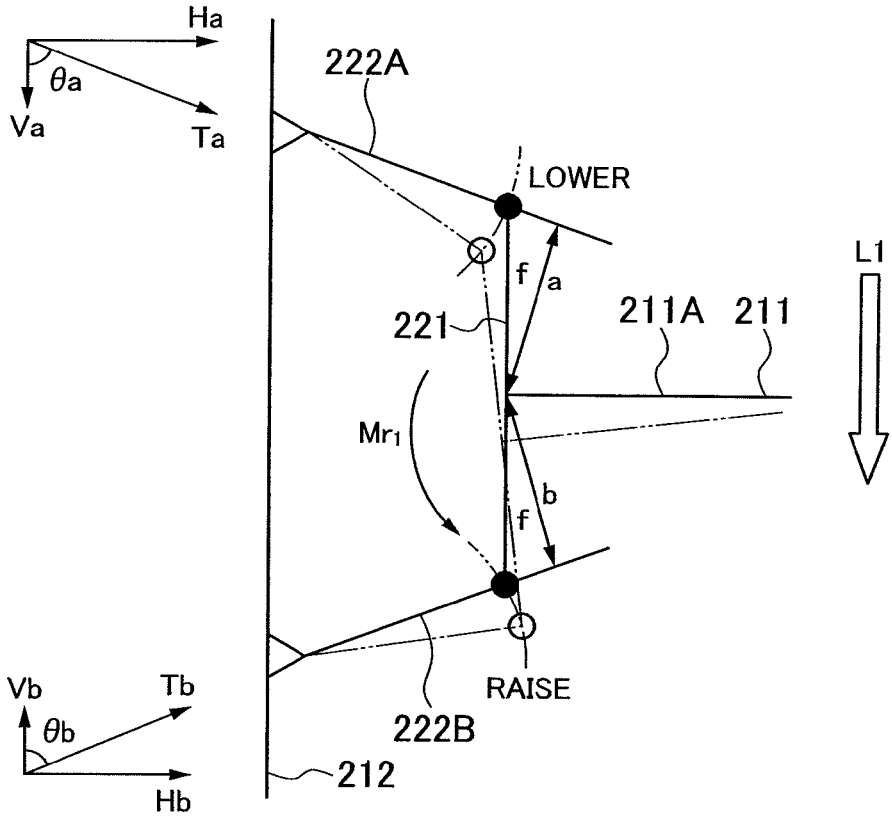
FIG. 30 is a schematic view showing a bending moment exerting on the beam joint connection.

FIGS. 28 to 30

As shown in FIGS. 28 and 29, a beam structure 210 comprising a bridge or the like has beam ends 211A on both ends of a simple beam 211, the beam ends 211A being joined to strong rigid bodies 212 on both sides by beam joint connections 220, respectively. In addition, a longitudinal direction of the beam 211 is arranged in a horizontal direction, and a vertical load L is exerted on the beam 211. The composition of the beam joint connection 220 will be described below (composition of the respective beam joint connections 220 provided on the beam ends 211A on both ends of the beam 211 are substantially the same, and mainly, the composition of the beam joint connection 220 provided on the beam end 211A on one end will be described).

The beam joint connection 220 rigidly joints a flange 221A to the beam end 211A, and the flange 221A serves as a base member 221.

The beam joint connection 220 is provided with a pair of rods 222 combined of two rods 222A and 222B between the rigid body 212 and the base member 221. The two rods 222A and 222B each have one end pin-jointed (applicable even in a rigid joint) to the rigid body 212 and their other end pin-jointed (applicable even in the rigid joint) to the base member 221. The other end interval between the two rods 222A and 222B is narrower than the one end interval therebetween (the rods 222A and 222B are formed in a truncated chevron shape with each other, so that the other end interval on the beam 211 side is made narrower than the one end interval on the rigid body 212 side). In the present embodiment, the rod 222A on the shear forward side along a direction of vertical shear force L exerted on the beam 211 is tilted backward, and the rod 222B on the shear backward side is tilted forward.

A supporting mechanism of the beam structure 210 will be described below about the beam joint connection 220 provided on one end side of the beam 211 (FIG. 30).

(1) The vertical shear force L is exerted on the beam 211. A vertical shear force L1, having the same direction as the shear force L exerted on the beam 211, is exerted on the base member 221 of the beam joint connection 220 provided on the beam end 211A on the one end side of the beam 211. In addition, a vertical shear force L2 having the same direction as the shear force L exerted on the beam 211 also is exerted on the base member 221 of the beam joint connection 220 provided on the beam end 211A on the other end side of the beam 211. The shear force L is L=L1+L2.

At this time, in the beam joint connection 220, a supporting point reaction force R1 (R2 in the case of the beam joint connection 220 provided on the other end side of the beam 211) is exerted on the joint portions of the two rods 222A and 222B to the rigid body 212. R1+R2=L and R1×a=R2×b are made, where distances between points of action of the shear force L to the beam 211 and a point of action of supporting point reaction forces R1 and R2 to the rigid body 212 are a and b, respectively.

(2) A bending moment Mc1 (Mc2 in the case of the beam joint connection 220 provided on the other end side of the beam) due to the shear force L exerted on the beam 211 is generated in a beam end 211A (a rigid joint point with the base member 221).

(3) Axial forces Ta and Tb are generated in the respective rods 222A and 222B by the supporting point reaction force R1 exerted on the two rods 222A and 222B. In addition, the axial forces Ta and Tb are generated when the base member 221 is made to move towards the same shear direction by the shear force L1 exerted on the beam 211.

Then, a bending moment Mr1 (Mr2 in the case of the beam joint connection 220 provided on the other end side of the beam) due to the axial forces Ta and Tb of the two rods 222A and 222B is generated at the beam end 211A (the rigid joint point with the base member 221). The bending moment Mr1 is in a reverse direction to that of a bending moment Mc1. The bending moment Mr1 lowers the other end of the rod 222A on the shear forward side, and raises the other end of the rod 222B on the shear backward side, so that the base member 221 is slightly rotated.

The following equations (1) to (5) are formed when horizontal components of the axial forces Ta and Tb are Ha and Hb, vertical components thereof are Va and Vb, arm lengths of the moments with respect to the beam end 211A (the rigid joint point with the base member 221) of the axial forces Ta and Tb are a and b, a flange length from a joint point with the beam end 211A to a joint point with the rod 222A in the base member 221 is f and a flange length therefrom to a joint point with the rod 222B is f, an intersecting angle made by the rod 222A with respect to the rigid body 212 is θa (FIG. 30), and an intersecting angle made by the rod 222B with respect to the rigid body 212 is θb (FIG. 30). In addition, axial force of the beam 211 is disregarded.

$$Q1+Q2=Ha+Hb \tag{1}$$

$$Va+Vb=0 \tag{2}$$

$$Mr=Ta\times a+Tb\times b \tag{3}$$

$$Mr=(Ha/\cos\theta a)\times a+(Hb/\cos\theta b)\times b \tag{4}$$

$$a=f\cdot\sin\theta a,\ b=f\cdot\sin\theta b \tag{5}$$

Therefore, in order to increase the bending moment Mr1, there is required an increase in angles θa and θb of the rods 222A and 222B, an increase in the flange length f of the base member 221, or an increase in the shear force L1 exerted on the base member 221.

The increase in the shear force L1 exerted on the base member 221 can be realized by receiving the vertical load L by beam members and transferring the same to the base member 221.

Furthermore, in the case where the joint of the rod 222A (222B) and the base member 221 or the rigid body 212 is pin-jointed, resistance against movement of the base member 221 is small; therefore, the base member 221 is largely moved, and Mr1 can also be increased. In the case of the rigid joint, since the resistance against movement of the base member 221 is large, Mr1 is small as compared with the pin joint; however, deformation of the rod 222A (222B) is very small, and therefore, generation of microvibration can be suppressed.

(4) In the case of Mr1=Mc1, the beam end 211A is in a rigid joint state (the beam end 211A does not rotate, and a relative angle between the beam 211 and the rigid body 212 is invariance).

(5) In the case of Mr1>Mc1, the beam end 211A is moved back in a reverse direction to a deformation direction due to Mc1. This is referred to as a super rigid joint state. The base member 221 moves to the shear direction (direction of L).

(6) In the case of Mr1<Mc1, the beam end 211A is in a semi rigid joint state (weaker than the rigid joint). The base member 221 moves in a reverse direction to the shear direction.

According to the present embodiment, the following operation effects are achieved.

(a) The base member 221 is rigidly joined to the beam end 211A, a pair of rods 222 combined of two rods 222A and 222B is provided between the rigid body 212 and the base member 221, the two rods 222A and 222B each have one end joined to the rigid body 212 and their other end joined to the base member 221, and the other end interval between the two rods 222A and 222B is made narrower than one end interval therebetween; and accordingly, the axial forces Ta and Tb of the two rods 222A and 222B exert the bending moment Mr1 on the base member 221, and the bending moment Mr1 reduces deformation of the beam 211 (displacement of the intersecting angle between the beam 211 and the rigid body) and operates so as to minimize deformation of the entire beam.

(b) When the shear force L is exerted on the beam 211 of the beam structure 210 and the axial forces Ta and Tb are generated in the two rods 222A and 222B, the bending moment Mr1, generated in the beam end 211A due to the axial forces Ta and Tb of the two rods 222A and 222B, is in a reverse direction to the bending moment Mc1 generated in the beam end 211A due to the shear force L exerted on the beam 211. Therefore, the deformation of the beam 211 due to the bending moment Mc1 and deformation of the beam 211 due to the bending moment Mr1 are balanced out with each other, the deformation of the beam 211 is reduced, and the deformation of the entire building is minimized.

(c) As described above in (a) and (b), the deformation of the beam 211 can be reduced by the bending moments Mr1 and Mc1 exerting on the base member 221; therefore, one end of the two rods 222A and 222B are not rigidly joined to the rigid body 212, but, deformation of the beam 211 is reduced even in the case of easily pin-jointing, and deformation of the entire building can be minimized.

(d) When the bending moment Mr1 and the bending moment Mc1 are set to Mr1=Mc1, the beam end 211A is in a rigid joint state with respect to the rigid body 212 (the beam end 211A does not rotate, and the intersecting angle between the beam 211 and the rigid body 212 is not displaced), and deformation of the beam 211 can be reduced.

(e) When the bending moment Mr1 and the bending moment Mc1 are set to Mr1>Mc1, the beam end 211A has deformation due to Mc1, which is moved back in a reverse direction by Mr1, and becomes in a super rigid joint state, so that deformation of the beam 211 can be reduced as compared with the above mention (d). The base member 221 moves in the shear direction.

INDUSTRIAL APPLICABILITY

A beam joint connection according to the present invention can be applied to a beam hung on a reinforced concrete (referred to as RC) structure (rigid body), a beam hung on a tunnel wall (rigid body), a beam hung on a basement wall (rigid body), a bridge hung on a bridge pier (rigid body), a beam hung on a steel structure (rigid body), a beam hung on a tower (rigid body), and a beam hung on a hull (rigid body).

What is claimed is:

1. A joint connection in which a beam end and a column base of a structure, or a peripheral member rigidly joined thereto, are joined to another structure capable of receiving a bending moment via supporting means, wherein a deformation due to a very small geometric movement within a resilient range is generated in the supporting means by a reaction force generated at a joint portion with the other structure due to an external force exerted on a beam or a column, thereby being capable of generating a bending moment Mr in a reverse direction to a bending moment Mc generated in the column base or the beam end, wherein the supporting means is a combination of at least two rods, each rod having a lower end joined to a lower structure, an upper end coupled by a coupling member, and the coupling member joined to the column base or the peripheral member; and the upper ends and the lower ends of the rods being separated respectively, and an upper end interval being made narrower than a lower end interval, wherein the joint of the column base or the peripheral member and the coupling member is of a tensile joint where introduction tensile force is exerted therebetween, and wherein the tensile joint is provided with a resilient bridging member at the bottom of the coupling member, the resilient bridging member having both ends supported to the coupling member or the rods, the resilient bridging member having an intermediate portion which is separated from the coupling member to be a rational cross section with small deformation, and the intermediate portion of the resilient bridging member and the coupling member is passed through by a bolt which is joined to the column base or the peripheral member.

2. The joint connection according to claim 1, wherein the moments are Mr=Mc.

3. The joint connection according to claim 1, wherein the moments are Mr>Mc.

4. The joint connection of the column base according to claim 1, wherein the lower structure is a foundation.

5. The joint connection of the column base according to claim 1, wherein the lower structure is a lower story building structure.

6. A building comprising a frame structure which includes a plurality of columns, at least one of the columns being joined to a lower structure by the joint connection of the column base according to claim 1.

* * * * *